US008020887B2

(12) United States Patent
Riepler et al.

(10) Patent No.: US 8,020,887 B2
(45) Date of Patent: Sep. 20, 2011

(54) SKI OR SNOWBOARD WITH A MEANS FOR INFLUENCING ITS GEOMETRY

(75) Inventors: Bernhard Riepler, Wagrain (AT); Rupert Huber, Radstadt (AT); Helmut Holzer, St. Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 535 days.

(21) Appl. No.: 12/009,773

(22) Filed: Jan. 22, 2008

(65) Prior Publication Data

US 2008/0185815 A1 Aug. 7, 2008

(30) Foreign Application Priority Data

Feb. 2, 2007 (AT) ..... A 174/2007

(51) Int. Cl.
*A63C 5/00* (2006.01)
*A63C 5/07* (2006.01)
*A63C 5/04* (2006.01)

(52) U.S. Cl. ..... 280/602; 280/607; 280/609

(58) Field of Classification Search ..... 280/601, 280/602, 607, 609, 610, 617, 633; *A63C 5/06, A63C 5/07*

See application file for complete search history.

(56) References Cited

U.S. PATENT DOCUMENTS 3,260,531 A 7/1966 Heuvel
3,260,532 A 7/1966 Heuvel
3,921,994 A 11/1975 Locati (Continued)

FOREIGN PATENT DOCUMENTS

AT 238 074 1/1965

(Continued)

OTHER PUBLICATIONS

European Search Report dated Apr. 2, 2008 with English translation of relevant parts.

*Primary Examiner* — Terrell McKinnon
*Assistant Examiner* — Chiedu A Chibogu
(74) *Attorney, Agent, or Firm* — Collard & Roe, P.C.

(57) ABSTRACT

The invention describes a ski (2) or a snowboard in the form of a board-type gliding device (1). By reference to the width (13) of the gliding board body, at least one slot (14) is provided in its middle portion extending in the depth direction—arrow (15)—from the top face (7) of the gliding board body in the direction towards the running surface facing (10) and in its longitudinal direction essentially parallel with the longitudinal direction of the gliding board body. This at least one slot (14) is provided with a view to causing a cross-sectional weakening and reducing the stiffness of the gliding board body transversely to its longitudinal direction. Also provided is at least one geometry-influencing means (19), by means of which the cross-sectional shape or contour of the gliding board body is variable as a function of load and/or can be manually varied. The geometry-influencing means (19) comprises a plate-type force-transmitting element (44), which extends across more than 50% of the length of the gliding board body and is supported within its longitudinal extension, at least in part-portions, on the top face (7) of the gliding board body so as to transmit load, and the plate-type force-transmitting element (44) is disposed so that it overlaps the least one slot (14) in the longitudinal direction and bridges it transversely to the longitudinal direction of the slot (14).

21 Claims, 5 Drawing Sheets

U.S. PATENT DOCUMENTS

| | | | | | |
|---|---|---|---|---|---|
| 4,449,735 | A | | 5/1984 | McDougall | |
| 4,565,386 | A | | 1/1986 | Crainich | |
| 4,936,603 | A | * | 6/1990 | Reynaud | 280/818 |
| 5,183,618 | A | | 2/1993 | Pascal et al. | |
| 5,232,241 | A | * | 8/1993 | Knott et al. | 280/607 |
| 5,366,234 | A | | 11/1994 | Rohrmoser | |
| 5,551,728 | A | | 9/1996 | Barthel et al. | |
| 5,820,154 | A | | 10/1998 | Howe | |
| 5,871,223 | A | * | 2/1999 | Zanco | 280/607 |
| 6,488,308 | B1 | * | 12/2002 | Clausing | 280/602 |
| 6,565,110 | B1 | * | 5/2003 | Holzer | 280/607 |
| 6,679,513 | B1 | | 1/2004 | Emig et al. | |
| 6,679,514 | B2 | * | 1/2004 | Luitz et al. | 280/607 |
| 6,857,653 | B2 | * | 2/2005 | Wilson | 280/602 |
| 7,077,419 | B2 | * | 7/2006 | Cuzzit et al. | 280/607 |
| 7,185,908 | B2 | | 3/2007 | Emig | |
| 7,264,262 | B2 | * | 9/2007 | Zanco | 280/602 |
| 7,290,784 | B2 | * | 11/2007 | Heil et al. | 280/617 |
| 7,344,149 | B2 | * | 3/2008 | Leitner | 280/607 |
| 2005/0062259 | A1 | | 3/2005 | Haas | |
| 2005/0167948 | A1 | * | 8/2005 | Riepler | 280/610 |
| 2005/0206128 | A1 | | 9/2005 | Gignoux | |
| 2007/0296181 | A1 | * | 12/2007 | Alary et al. | 280/601 |
| 2008/0106069 | A1 | * | 5/2008 | Holzer et al. | 280/602 |

FOREIGN PATENT DOCUMENTS

| | | | | |
|---|---|---|---|---|
| AT | 504069 | B1 | * | 7/2006 |
| DE | 24 17 156 | | | 11/1974 |
| DE | 32 00 383 | | | 9/1982 |
| DE | 84 22 316 | | | 11/1984 |
| DE | 85 12 315 | | | 9/1985 |
| DE | 34 44 345 | | | 6/1986 |
| DE | 38 03 483 | | | 9/1988 |
| DE | 41 30 110 | | | 4/1992 |
| DE | 43 24 871 | | | 1/1995 |
| DE | 198 36 515 | | | 2/1999 |
| DE | 199 17 992 | | | 11/2000 |
| DE | 201 13 739 | | | 4/2002 |
| DE | 29803460 | | * | 3/2007 |
| EP | 0 034 643 | | | 9/1981 |
| EP | 0 279 648 | | | 8/1988 |
| EP | 0 474 967 | | | 3/1992 |
| EP | 0 490 044 | | | 6/1992 |
| EP | 0 542 123 | | | 5/1993 |
| EP | 1 297 869 | | | 4/2003 |
| EP | 1 516 652 | | | 3/2005 |
| FR | 2 794 374 | | | 12/2000 |
| FR | 2 815 879 | | | 5/2002 |
| SI | 20 803 | | | 8/2002 |
| WO | WO 00/62877 | | | 10/2000 |
| WO | WO 02/070086 | | | 9/2002 |
| WO | WO 2004/045727 | | | 6/2004 |

* cited by examiner

SKI OR SNOWBOARD WITH A MEANS FOR INFLUENCING ITS GEOMETRY

CROSS REFERENCE TO RELATED APPLICATIONS

Applicants claim priority under 35 U.S.C. §119 of AUSTRIAN Patent Application No. A 174/2007 filed on Feb. 2, 2007.

BACKGROUND OF THE INVENTION

1. Field of the Invention

The invention relates to a ski or a snowboard in the form of a board-type gliding device, of the type defined in claim 1.

2. Prior Art

Patent specification EP 1 297 869 A1 discloses a gliding snowboard, in particular a ski, and a prising mechanism for its gliding board body. The width of the gliding board body can be varied across at least a partial length by means of this prising mechanism. The prising mechanism thus causes the gliding board body to prise open depending on the load or flexing of the gliding board body. This prising mechanism comprises a plurality of prising levers disposed in pairs, which cause the gliding board body to be prised apart in the region of a slot at the rear end of the ski. The slot, which becomes wider and narrower as a function of load, is therefore disposed at a rearward end of the gliding board body. When the prising mechanism is operated with a view to reducing or increasing the angle subtended by the two prising levers, the rear end of the gliding board body is prised open. In the case of another embodiment, an adjusting element may be provided, by means of which the prising element of the prising mechanism can be pre-set. With the proposed designs, the rear end of the gliding board body is slotted and the prising mechanism is integrated inside the slot or the resultant recess, which occupies approximately one third of the ski width. The described prising mechanism is of a relatively complex construction and the change which can be achieved in terms of the travel or turning behavior of the gliding board body with the previously known design can be made to a significant degree only if the rear end of the gliding board body is subjected to a relatively strong, elastic prising action. In order to obtain pronounced changes in the geometry or travel behavior of the gliding board body, therefore, it is necessary to produce strong deformations or elastic prising forces at the rear end, as a result of which the loads acting on the gliding board body can rapidly reach a problematically high degree or the desired extent of variations in the travel behavior can be achieved, but only with great difficulty, due to the fact that the adjusting forces are not strong enough for the prising mechanism.

Patent specification DE 43 24 871 A1 describes a gliding board body, which may be made up of three structurally separate board-type elements. In particular, a gliding board, especially a snowboard, is made up of a total of two skis and a middle part disposed in between, additionally using plates. Disposed in the middle portion of the gliding board is a clamping means, by means of which the skis disposed to the side of the middle part can be clamped with respect to one another causing an elastic deformation in its transverse direction, thereby enabling the gliding board to be adjusted to the desired contour radius. When the two outer skis are clamped to one another by the clamping means, the gap becomes smaller and smaller as the skis becomes more deformed in the transverse direction until it disappears altogether when the two skis lie in full abutment with the middle part. As a result of this clamping action and deformation of the skis, the contour radii which are ultimately imparted to the fully assembled gliding board or snowboard are significantly smaller than those of the skis. The disadvantage of this is that this gliding board is awkward to handle and the requisite components, in particular the plate parts, are mechanically complex and significantly increase the overall weight of the gliding board body.

Patent specification DE 34 44 345 A1 describes a so-called double-runner ski, whereby two runners of a ski extend parallel with one another and curve upwards at the two mutually joined ends. However, it is also possible to provide several, in particular three or four, runners per ski extending parallel with one another, in which case they are joined at their oppositely lying ends to form a unit. The slot between the double runners extending longitudinally down the centre is intended to permit snow which has built up in front of the tip of a ski to flow away more efficiently. Rounded inner edges of the two runners are intended to make the ski easier to rotate or turn. However, the proposed designs have only a limited use in practical applications.

Document DE 85 12 315 U1 describes a ski, the rear portion of which is split by means of a slot. The width of the slot can be made smaller and bigger by means of an adjusting element so that the rear portion of the ski can be varied in terms of the contour of its side edges. Although the slot in the rear end of the ski body enables changes to be made to the ski geometry, the extent of the changes is only satisfactory under certain conditions, given that the capacity of the rear ski end to prise open is limited by structural and design constraints.

Document DE 84 22 316 U1 describes a ski, the front and rear portion of which have longitudinally disposed slots extending from the binding mounting portion towards the front and towards the rear and terminating just short of the respective end of the ski, thereby resulting in integral, transversely stable ski ends. By means of respective co-operating adjusting elements, the width of the slots can be varied, thereby enabling the contours of the side edges to be varied independently of one another in the front and rear portion of the ski. The disadvantage of this approach is that the geometry which can be set using this construction causes the contours of the side edges to become non-homogeneous or non-uniform relatively quickly which is detrimental to the control behavior of the ski. In particular, it becomes more difficult to "ride on the edge", which is in important to the dynamics or acceleration of the ski when starting to turn, which can cause problematic skidding phases during turning.

Patent specification DE 24 17 156 A1 describes a ski comprising at least two gliding strips disposed adjacent to one another. These gliding strips are joined to one another by fixing means to permit a relative movement of the two gliding strips in the vertical direction with respect to their gliding surface, at least in their middle portion. This results in a multiple, in particular twofold, edge support, which is intended to produce a better grip to prevent lateral skidding. The mechanical coupling between the two gliding strips requires complex mechanisms, which means that a design of this type is of only limited practical value.

Patent specification FR 2 794 374 A1 discloses various designs for changing the geometry of a ski, in particular the side edge contour. In one of the proposed embodiments, both ends of the ski may be provided with slots, which extend across the end of the ski, resulting in longitudinally extending cuts in the oppositely lying ends of the ski. Close to the front and rear end of the ski, adjusting means are provided, which are mechanically coupled or act independently of one another and enable the respective ends of the ski to be made narrower or prised open. Although these features enable the travel properties of the ski to be influenced to a significantly higher degree, the performance which can be achieved with such a gliding device is still not particularly satisfactory.

Patent specification EP 1 516 652 A1 describes a snow gliding board, in particular a snowboard, which has a recess in at least one of its ends, in which an insert is fitted. This insert is designed so that it has at least one mound or recess on its bottom face, which is open towards the bottom face of the gliding board body. The insert is made from a permanently deformable material, in particular a thermoplastic polymer or plastic, which is permanently deformed to a cambered shape standing proud of the top face of the gliding board body during the process of manufacturing the snowboard. These recesses or cut-outs in the running surface of the snowboard are intended as a means of positively influencing the flow of snow and aiding gliding in the snow. Especially in the case of powdery snow, the intention is to produce a better guiding action for the snowboard and a reduced resistance in the rearward shovel region. In particular, the intention is to improve deep snow properties for a snowboard. An individual change in the guide properties, in particular the turning behavior, of the snowboard is not possible, however, due to the fact that the insert piece fitted in the recess is made from a permanently deformed, thermoplastic plastic material.

Document DE 201 13 739 U1 describes a snowboard, which has a slot essentially along its mid-axis, extending from the rear end of the gliding board body at least as far as its middle portion, thereby forming two rear arms separated from one another, which are joined to one another by the integral front portion. This slot extends from the rear to the front in a wedge shape tapering to a point, and the slot in the rear portion of the snowboard is wider than in the middle portion of the snowboard. In addition, this slot may merge into a recess which extends in the direction towards the front portion of the snowboard, gradually disappearing. An adjusting mechanism is also provided, which acts on the two legs of the snowboard and is provided in the form of a threaded spindle arrangement. This enables the distance between the two legs to be adjusted and to be so in the pulling direction, i.e. so that the slot becomes narrower, as well as in the pushing direction, i.e. so that the slot becomes wider. Consequently, the contour and hence the travel behavior of the snowboard can be individually varied to a certain extent. The disadvantage of this approach is that the slot in the gliding board body, which extends from the rear end across more than half of the total length of the gliding board, is made up of two legs which run away from one another independently across extensive portions and are therefore subjected to high loads. In particular, the gripping ability of the edges or tracking of such a design are only satisfactory under certain conditions because high torsional loads act on the relatively narrow legs of the snowboard during turning, which can cause relatively pronounced twisting of the legs about their longitudinal axis. Especially if edge loads occur, as is often the case with cut swinging actions in particular, the tracking and stability desired by the user are difficult to obtain.

Patent specification DE 41 30 110 A1 describes a ski with a three-dimensionally profiled top face. The ski is formed by a one-piece composite body, comprising a plurality of layers or plies adhesively joined to one another. In particular, this one-piece ski comprises a top belt, a bottom belt, side faces and a core surrounded by these top elements. The top belt is made up of several layers. Disposed between one layer of the top belt and a surface layer or the core is an intermediate layer, which has a differing thickness and/or width in the longitudinal direction. This intermediate layer may incorporate a support and/or damping element or may be formed by it. The ski binding is secured by fixing means, such as screws for example, to the one-piece ski, for example via the intermediate layer and/or the core. In particular, the binding fixing screws extend into the core element of the ski and terminate just short of the bottom face of the ski. Adhered to the top face of the ski body or integrally formed therewith, the top belt construction with its width and/or thickness dimensions which vary in steps produces stepped effects on the stiffness curve of he one-piece, multi-layered ski. Such a ski is also of a relatively stiff design in the region of the binding mounting zone, especially when a shoe is inserted in the ski binding.

Patent specification WO 00/62877 A1 describes an alpine ski with a body made up of several elements, which has a running surface on its bottom face and a region on its top face for attaching a binding. This structure also has at least one top belt element which is primarily subjected to compression and at least one bottom belt element which is subjected to tension. The top belt element has a flat, upwardly cambered arch in the middle region of the ski, which extends in the longitudinal direction of the ski and spans the bottom belt element. The arch of the top belt element is therefore able to flex in the direction towards the bottom belt element depending on the load emanating from the binding. At the end regions of the ski, the top belt element is supported so that the shift in the ends of the top belt element caused by the flexing of the arch increases the amount of support afforded by the end regions of the ski. This design enables a more uniform distribution of surface pressure to be obtained across the running surface of the ski. The highest possible support length of the ski edges can also be achieved, which slightly improves stability when travelling in a straight line as well as the reaction of the alpine ski to control pulses of the skier. However, the travel dynamics or the enjoyment which can be achieved with this design is still not satisfactory for many skiers.

Patent specification WO 2004/045727 A1 describes an alpine ski with a ski body, which has a running surface on its bottom face and, on a top face, facing away from its running surface, at least one top belt element extending in the longitudinal direction of the ski body which absorbs tension and compression forces. This top belt element is supported on the ski body by its ends, and a wave-shaped support structure is provided on the top face of the ski body, on which the top belt element is mounted. The wave-shaped support structure is formed by a longitudinally extending flat component, which is bent at an angle with respect to the running surface about spaced apart, essentially parallel axes extending transversely to the longitudinal direction of the ski. This is intended to produce good running properties and good controllability of the alpine ski. In particular, a good compromise can be obtained between the desired bending elasticity on the one hand and the required torsional stiffness of the ski on the other hand. A uniform distribution of surface pressure is advantageously also obtained. However, the travel dynamics which can be achieved are satisfactory for only a limited number of skiers.

Patent specification DE 198 36 515 A1 filed by this applicant discloses a distribution mechanism for transmitting loads and/or forces on a sports device, as well as a sports device incorporating same. The distribution mechanism comprises a support element for a coupling mechanism designed to retain the sports shoe of a user. This plate-type support element for the coupling mechanism can be connected to a board-type sports device, in particular a ski, at its end regions by means of articulated joint arrangements. At least one end region of the plate-type support element is connected to an intermediate support so that it can pivot via an articulated joint arrangement, which in turn is supported on the board-type sports device and/or on another support holder by means of two articulated joint arrangements spaced at a distance apart from one another in the longitudinal direction towards the support element. By means of this support construction comprising a plate-type support element for the coupling mechanism and several intermediate supports and articulated joint arrangements disposed between the top face of the sports device and the support element, the forces to be transmitted from the support element to the sports device, in particular emanating from the middle region, are distributed as uniformly as possible. The disadvantage of this approach is that the arcuate intermediate support and the respective linking articulated joint arrangements increase the complexity of the structure, thereby making the overall weight of such a sports device relatively high. Furthermore, the standing height for the foot of the user is relatively high compared with the running or gliding surface of the sports device, and the various articulated joint arrangements and longitudinal guides do not guarantee the desired ability to turn and slide longitudinally between the respective components under adverse usage conditions to a sufficiently high degree.

Patent specifications U.S. Pat. No. 3,260,531 A and U.S. Pat. No. 3,260,532 A describe designs for distributing forces and affording support similar to that outlined in respect of the publication above. These designs are intended to result in a ski which is capable of adapting to different types of terrain as far as possible, due to a high flexibility and as low a torsional stiffness as possible. To this end, it is proposed that elastic and/or articulated or length-compensating coupling mechanisms be provided between a support plate for the user's shoe and the actual gliding board body. These designs, which are also intended to enable the gliding board body to be optimally adapted to the respective nature of the ground, also fail to offer the user satisfactory gliding and guiding properties. In particular, the controllability of such ski designs is not very satisfactory for the user.

SUMMARY OF THE INVENTION

The underlying objective of this invention is to propose a ski or a snowboard, which has manually adjustable properties and/or travel properties which can be varied as a function of load, and the performance which can be achieved when using such a gliding board body is as high as possible. In particular, the intention is to produce improved turning behavior of a ski or snowboard with a side edge geometry or contour which can be varied.

This objective is achieved by the invention on the basis of a board-type gliding device incorporating the characterizing features disclosed herein. The essential aspect is that the ski with a variable geometry proposed by the invention or the snowboard with a variable geometry proposed by the invention with a view to varying its travel properties offers significant advantages over board-type gliding devices with a variable geometry known from the prior art. In particular, a ski or snowboard is obtained, the side edge geometry of which—and hence also its travel behavior—varies or can be varied to a relatively pronounced degree as a function of the prevailing loads and/or as a function of individual requirements, but the claimed winter sports device nevertheless afford an excellent edge grip and tracking, which is especially important when turning or with a view to starting to turn correctly. In particular, the specified plate-type force-transmitting element imparts to the gliding board body exactly the desired stability or strength to enable cut or so-called "carved" turns to be made in the snow as safely and controllably as possible. The claimed board-type gliding device therefore gives the user the requisite, sufficiently high stability and imparts a high controllability or guiding stability to the gliding device as a whole. Above all, as the load on the gliding device increases during a turning phase, the gliding board body in contact with the ground underneath unexpectedly flexes or virtually kinks, causing the board-type gliding device to suddenly assume a behavior that is difficult to control. In particular, a harmonious or uniform turning action can be generated within a relatively high load region of the gliding board body, which also increases personal safety when using the gliding board body proposed by the invention. The specified plate-type force-transmitting element therefore stabilizes the gliding board, the strength or stiffness of which is modified to a pronounced degree in certain portions by the slot, resulting in good controllability and a conducive guiding behavior whilst nevertheless enabling a relatively wide-ranging or pronounced change to be achieved in the contour, in other words the lateral shape of the gliding board body. In particular, the plate-type force-transmitting element prevents the gliding board slats lying on either side of the slot from deviating from one another to an undesirable degree in the direction perpendicular to the running surface facing. The plate-type force-transmitting element also at least does not prevent the gliding board slats lying on either side of the slot from moving closer to one another or apart from one another as desired or this is even assisted and/or effected by the plate-type force-transmitting element, thereby actively influencing the guiding behavior or degree of directional change when the contour of the ski or snowboard is influenced via the co-operating geometry-influencing means as a function of load.

As a result of the features according to an embodiment of the invention, the stabilizing and at the same time geometry-influencing function of the plate-type force-transmitting element is transmitted to correspondingly extensive longitudinal portions of the gliding board body. In particular, the multi-functional effect, i.e. the geometry-influencing and stabilizing effect, of the plate-type force-transmitting element acts on the gliding board body to a high degree without the need to provide structurally complex features.

The advantage of another embodiment disclosed herein is that the force-transmitting element is able to act on the gliding board body very effectively because the force-transmitting element extends across extensive portions of the gliding board body. In particular, such a force-transmitting element acts on the gliding board body close to the end portions of the gliding board body, which on the one hand results in a good stabilizing function and on the other hand produces a sufficiently pronounced variability in the cross-sectional shape, in particular the cross-sectional width, of the gliding board body in at least one of its end portions.

Also of advantage is the feature of another embodiment disclosed herein wherein the forces applied by the user or the control movements initiated by the user can be transmitted via the interconnected force-transmitting element to precisely those portions of the gliding board body where the force-transmitting element is able to act on the gliding board body most effectively.

Also of advantage is another embodiment disclosed herein wherein a high-strength coupling is obtained and force can be transmitted as directly as possible and without delay between the force-transmitting element and the gliding board body. In addition, the requirements placed on the screw connection, in particular anchoring strength and resistance to tearing out, can be reduced whilst nevertheless enabling a high-strength coupling to be obtained between the force-transmitting element and the gliding board body.

Also of particular advantage is another embodiment disclosed herein. As a result of this construction, a longer screwing-in depth or a longer, active thread length can be obtained for the screw-type fixing means of the binding mechanism, thereby offering a high degree of reliability so that the screw-type fixing means will not be torn out. The thickness or vertical height of the plate-type force-transmitting element can still be selected so that it is relatively short, however, which means that the overall height of the gliding device, in particular the standing height of the user of the gliding device above the ground underneath can be kept low, even though the gliding board body has a plate-type force-transmitting element mounted on top of it. In particular, this enables a relatively long overall or thread length to be selected for the screw-type fixing means of the binding mechanism, in which case these screw-type fixing means are anchored exclusively in the plate-type force-transmitting means sufficiently strongly to prevent them from being torn out. In particular, the screw-type fixing means do not penetrate the top face of the gliding board body lying underneath and the screw-type fixing means are not anchored in the gliding board body but it is still possible to obtain the requisite tearing resistance without any difficulty. At the same time, a conducive bending behavior is imparted to the gliding board body, in particular an improved bending characteristic curve, because the gliding board body remains elastically deformable in a relatively homogeneous shape in extensive part-portions with respect to the plate-type force-transmitting element.

The features of another embodiment disclosed herein are are of advantage because in spite of permitting a relatively slim plate height of the plate-type force-transmitting element, the screw means used to mount a binding mechanism are still highly resistant to being torn out. Even so, the plate-type force-transmitting element with the binding mechanism secured to it remains so that it can slide freely as far as possible in the longitudinal direction relative to the gliding board body disposed underneath it, thereby avoiding tensions between these components as they flex.

The embodiment defined in claim 8 is of advantage because a guide mechanism is provided, extending in the longitudinal direction of the gliding device, which increases the transverse stability between the plate-type force-transmitting element and the gliding board body. In particular, this enables strong forces to be transmitted between the gliding board body and the plate-type force-transmitting element without any deviating movements and without any increased risk of these components being damaged. Due to the partially positive coupling between the plate-type force-transmitting element and the gliding board body, the additional connecting elements needed between these components, in particular fixing screws, may also be of a lower rating and/or the number of them used can be reduced and/or their positioning optimized.

Also of advantage are the features of another embodiment disclosed herein, whereby a pronounced positive connection is generated in those portions where the gliding board body and/or the plate-type force-transmitting element has its biggest thickness or depth, which improves the quality of the connection between these components. By contrast, the positive connection in those portions of the gliding device where the gliding board body and/or the force-transmitting element have a relatively slim thickness or height is less pronounced. In particular, this avoids any additional weakening in the gliding board body in those portions where it is of a relatively short height. Another advantage of this embodiment is that it produces a high resistance to twisting, due to the positive coupling between the plate-type force-transmitting element and the gliding board body extending longitudinally by reference to an axis extending perpendicular to the running surface facing.

The advantage of the features of another embodiment disclosed herein is that a strong positive coupling can be established between the force-transmitting element and the gliding board body without the need for drastic modifications to the standard construction of a gliding board body, in particular an alpine ski, in order to achieve the requisite load-bearing capacity and make the distal end portions of the gliding board body advantageously lightweight. In particular, virtually standard construction methods may be employed which have proved themselves in practical applications, in order to produce the gliding device proposed by the invention, comprising the gliding board body and the force-transmitting element mounted or supported on it, as inexpensively and reliably as possible.

Also of particular advantage is the feature of another embodiment disclosed herein, which prevents tensions between the plate-type force-transmitting element and the gliding board body as far as possible. In particular, it ensures that the end portions of the plate-type force-transmitting element are able to effect a relative movement with respect to the gliding board body when the gliding board body and the plate-type force-transmitting element are subjected to elastic flexing, such as occurs when travelling over mounds and above all when turning. This is conducive to producing a sufficiently pronounced effect on the cross-sectional or side edge geometry of the gliding-device. It also ensures that the gliding board body has an ideal bending characteristic curve as far as possible because its bending behavior is influenced by the plate-type force-transmitting element as little as possible especially in the region of the mounting zone for a binding mechanism, thereby enabling a bending characteristic curve to be achieved that is as harmonious and uniform as possible. As a result of the features of an embodiment disclosed herein, a virtual packet of board-type or plate-type elements is obtained, which permits relative movements in the longitudinal direction between the bottom face of the plate-type force-transmitting element and the top face of the gliding board body when the overall construction is subjected to an arcuate, elastic flexing. At the same time, however, a higher resistance is afforded to prevent deviating or slipping movements in the direction extending transversely to the longitudinal axis of the gliding device and such transverse shifting is pre-vented altogether as far as possible. This is also conducive to the travel or gliding behavior of the ski or snowboard proposed by the invention.

The features of another embodiment disclosed herein permit a static pre-setting of the respective desired geometry of the gliding board body to suit the individual wishes of the user and/or a dynamic change in the geometry of the gliding board body whilst it is being used, thereby imparting better agility to the gliding board body. In addition, using the simplest possible means which will remain functionally reliable for the long term, an interesting travel behavior can be achieved and a versatile range of uses is opened up to the user, thereby increasing his pleasure or fun in using the gliding device proposed by the invention.

A particularly robust embodiment of a geometry-influencing means based on an advantageous design is also disclosed herein. In particular, high adjusting forces can be transmitted between the geometry-influencing means and the gliding board body without the need for complex or expensive modifications to the ski or snowboard.

The advantage of another embodiment disclosed herein is that a robust geometry-influencing means is obtained which can be produced as inexpensively as possible and which also enables the cross-sectional geometry or side shape of the gliding board body to be varied within a broad effective range. In particular, a simple and reliable way of converting a longitudinally directed movement into partly transverse movements is obtained and this embodiment will also remain as far as possible functionally stable or functionally reliable under the relatively rough conditions under which the gliding device, in particular the winter sports device, is used.

The advantage of another embodiment disclosed herein is that a so-called sandwich compound element is produced, which acts as a plate-type force-transmitting element. In particular, this is based on a design construction which has been tried and tested for many years in the production of board-type gliding devices, in particular winter sports devices. Above all, a particularly stable plate-type force-transmitting element which best meets current requirements is obtained, the manufacturing costs of which can be kept to a minimum because the equipment and materials conventionally used by producers of the gliding device can also continue to be used or employed to produce the plate-type force-transmitting element. Furthermore, plate-type force-transmitting elements can be produced which offer a good ratio between strength and lightness of weight. Also of particular advantage is the fact that the plate-type force-transmitting element is ideally able to assume the function of imparting some of the requisite static overall strength, which means that the gliding board body lying underneath can be made to correspondingly smaller dimensions in terms of its structure, without causing problems with regard to robustness or every day use of the gliding device as a whole.

The features of another embodiment disclosed herein result in a plate-type force-transmitting element which advantageously meets current technical requirements. In particular, such a force-transmitting element is able to withstand prevailing stresses without any difficulty and the requisite forces can be transmitted and absorbed with a high degree of reliability. Such a plate-type force-transmitting element is also relatively lightweight but still of a sufficiently stable design. Another major advantage resides in the fact that the components needed to produce the structure of conventional skis or snowboards can also be used for the plate-type force-transmitting element, thereby making production as cost-effective as possible. This production cost advantage is further enhanced due to the fact that the machinery used to produce conventional skis or snowboards can also be used to produce the plate-type force-transmitting element, which makes production of a gliding device proposed by the invention economic for the manufacturer. Moreover, existing know-how involved in producing skis or snowboards can also be used to produce high-quality plate-type force-transmitting elements. Another major advantage resides in the fact that it is possible to produce an extremely attractive and advantageous visual appearance of the gliding device because the plate-type force-transmitting element and the actual gliding board body are able to form what is visually a relatively homogenous appearance with a designer look. In particular, the decorative methods or decorative options which are used on conventional skis and snowboards and have proved themselves in practical application can also be used for the plate-type force-transmitting element. In particular, the appearance of the plate-type force-transmitting element can be ideally combined with the appearance of the gliding board body disposed underneath it. This firstly results in a good and harmonious appearance and also simplifies technical production, resulting in better economy, amongst other things.

The features of another embodiment disclosed herein primarily result in a force-transmitting element which satisfies requirements in terms of strength, design and economy.

The features of another embodiment disclosed herein produce a longitudinal compensation that is as obstacle-free as possible between the plate-type force-transmitting element and the gliding board body, which more easily results in improved bending behavior, in particular a bending characteristic curve of the overall construction that is as ideal as possible. Furthermore, such longitudinal compensating movements can be converted as effectively as possible into movements or adjusting forces for varying the cross-sectional shape of the gliding board body. This also prevents the appearance of abrasion or scratches so that the attractive appearance of the ski or snowboard in the region of the zones of relative movement between the force-transmitting element and the gliding board body are preserved for a long time.

As a result of the features of another embodiment disclosed herein, the performance which can be achieved with the ski proposed by the invention or snowboard proposed by the invention and the resultant travel behavior is decisively improved and maintained at a high level. In particular, the tracking and controllability of the specified ski or snowboard is significantly improved and positively influenced. Furthermore, it is also possible to produce a sufficiently pronounced cross-sectional variability whilst nevertheless obtaining good tracking ability and a turning behavior which the user of the specified gliding device can reliably anticipate.

The features of another embodiment disclosed herein offer the advantage of enabling a good compromise to be reached between a sufficiently pronounced variability in the cross-section or side shape of the gliding device and a stability that is sufficient to guarantee good travel or turning behavior. In particular, a ski of this design or a snowboard of this design with a variable geometry is very practical.

Finally, the features of another embodiment disclosed herein are of advantage because an essentially X-shaped gliding board body split at both ends is obtained when viewed from above, the travel and turning behavior of which are or can be varied to a sufficiently pronounced degree when the two ends are subjected to what is only a relatively low geometry-influencing effect or prising action. In particular, this enables relatively pronounced changes in the cross-section or side shape to be achieved with low loads at the terminal-end gliding board slats of the gliding board body. As a result of this embodiment, therefore, stress in the material and substances used for the gliding board body can be kept relatively low but a change in the travel or turning behavior is obtained which is still sufficiently perceptible to the user.

BRIEF DESCRIPTION OF THE DRAWINGS

Advantageous embodiments of the invention will be described in more detail below with reference to examples of embodiments illustrated in the appended drawings. Of these.

DETAILED DESCRIPTION OF PREFERRED EMBODIMENTS

Figure 1:
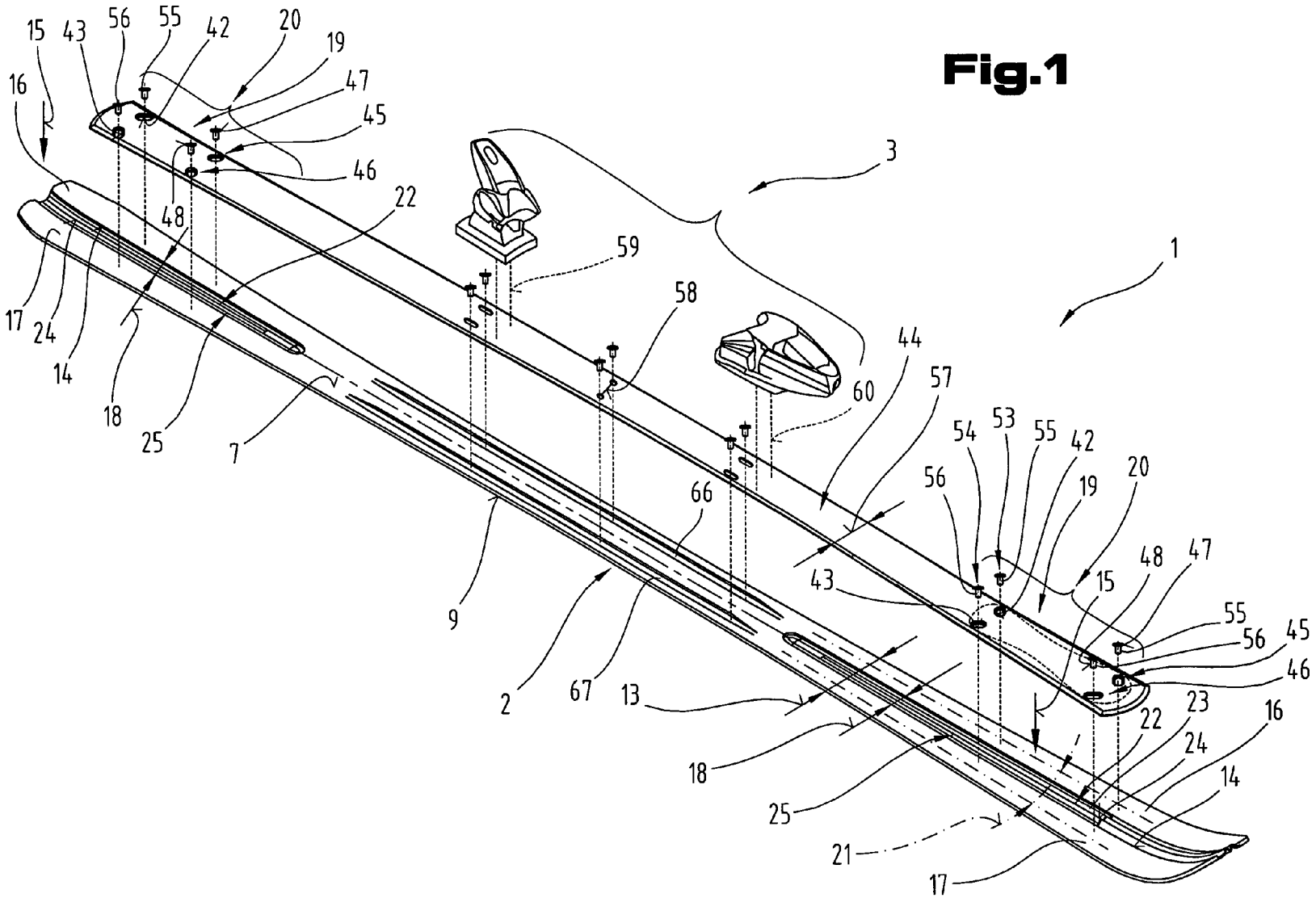
FIG. 1 is a simplified, perspective view illustrating a board-type gliding device, in particular a ski, with slots extending longitudinally down the centre and a geometry-influencing means for producing a cross-sectional geometry which varies as a function of load.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

FIGS. 1 to 6 illustrate a preferred embodiment of a board-type gliding device 1 with a geometry which can be varied as a function of load. In particular, the schematically illustrated ski 2 has a cross-sectional geometry or contour which varies depending on the prevailing load when up-ended on the lateral control edges. In these drawings, only the components which are the most essential are illustrated by way of example. Also in the individual drawings, only the most essential parts of components are illustrated, in particular of the gliding board base body and the means for influencing the geometry of the gliding board body.

By preference, the board-type gliding device 1 is a ski 2 or a snowboard. In a known manner, such a ski 2 is used in pairs, whereas the user of a snowboard is supported with both feet on a single board body. In order to connect the feet of the user to the gliding device 1, the latter has a least one binding mechanism 3, which may be designed as a safety-release binding or a binding which provides a coupling without flexing.

The board-type gliding device 1 is based on a sandwich or monocoque structure. In other words, a plurality of layers are joined to one another by adhesive and together constitute the one-piece base body of the gliding device 1. In a known manner, these layers form at least one top belt 4 which imparts strength, at least one bottom belt 5 which imparts strength and at least one core 6 disposed in between. The top belt 4 and/or the bottom belt 5 may be made from at least one plastic layer and/or metal layer and/or fibre layer and/or epoxy resin layer and such like. In a known manner, the core 6 may be made from wood and/or from foamed plastics. The core 6 therefore essentially spaces the top belt 4 apart from the bottom belt 5 of the gliding device 1, both of which impart strength.

Figure 4:
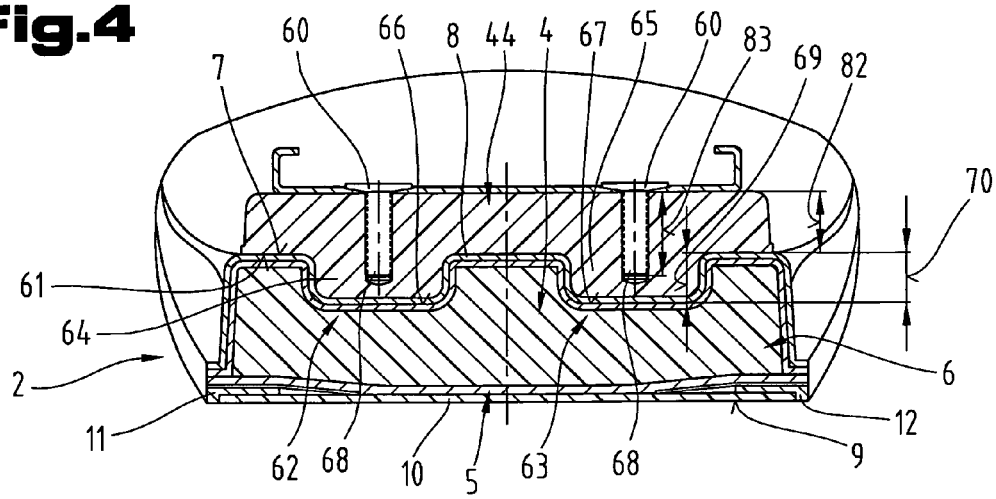
FIG. 4 shows the ski illustrated in FIG. 3, viewed in section along line IV-IV indicated in FIG. 3.

The top face 7, i.e. the top external face of the gliding device 1, is formed by a top layer 8, which primarily fulfils a protective and decorative function. The bottom face 9, i.e. the bottom surface of the gliding device 1, is formed by a running surface facing 10, which should have the best possible gliding properties with respect to the ground underneath, in particular with respect to snow or ice. In this respect, the top layer 8 may also extend across at least certain regions of the side faces of the board-type gliding device 1 and form a box-type structure in conjunction with the running surface facing 10, as may be seen in particular from the diagram in cross section shown in FIG. 4. The side edges of the running surface facing 10 are preferably bounded by control edges 11, 12, preferably made from steel, to permit an exact as possible and largely slip-free guiding action of the gliding device 1, including on relatively hard ground. The control edges 11, 12 which are key to controlling and guiding the gliding device 1, are rigidly joined to the structure, in particular to the running sole or bottom belt 5 of the gliding device 1. The control edges 11, 12 are preferably positively and non-positively fixed in the gliding device structure in a manner known per se. Similarly, the running surface facing 10 is permanently joined to the gliding device structure, in particular to its bottom belt 5, across its entire top flat face directed towards the core 6. The running surface facing 10 is preferably adhered to the surrounding components of the gliding device 1 by its entire surface. The running surface facing 10 or bottom face 9 of the gliding device 1 is of a flat or straight design in cross-section, as illustrated in FIG. 4, when the gliding device 1 is in its original state not placed under load, in which case the gliding device 1 in the initial state free of load has an essentially flat bottom face 9 and running sole.

The structure described above is decisive in determining the strength of the board-type gliding device 1, in particular the bending behavior and torsional stiffness. These strength values are predefined or predetermined by the materials used and layer thicknesses and by the methods used for joining purposes. The essential factor is that the specified board-type gliding device 1 has at least one geometry-influencing means 19 which produces a cross-sectional geometry or contour of the gliding device 1 and this cross-sectional geometry or contour of the gliding device 1 is variable as a function of load and/or can be manually varied, in particular can be pre-set. By contour is meant the so-called "side-cut" or side edge radius of the gliding device 1. The contour of the gliding device 1 which is predefined by its design therefore results in a width 13 of the gliding device 1 which can be varied in the longitudinal direction of the gliding device 1.

By reference to the width 13 of the gliding device 1, the geometry-influencing means 19 of the gliding device 1 has at least one slot 14 disposed at least in the middle portion of the gliding device 1. This slot 14 in the gliding board body extends, with respect to its longitudinal extension, in the longitudinal direction of the gliding device 1 and, with respect to its depth direction—arrow 15—from the top face 7 of the gliding device 1 in the direction towards the running surface facing 10. By reference to its longitudinal direction, the at least one slot 14 extends essentially parallel with the longitudinal direction of the gliding device 1, as may best be seen from FIG. 1. The at least one slot 14 along the longitudinal middle portion of the ski 2 is dimensioned and designed so that it causes a cross-sectional weakening of the gliding device 1 and in particular reduces the stiffness or dimensional stability of the gliding device 1 transversely to its longitudinal direction.

As may best be seen from FIG. 1, the slot 14 is disposed at least in the front portion, i.e. in the part-portion between the binding mechanism 3 and the front end of the gliding device 1. By preference, such a slot 14 may also be provided in the rear portion of the gliding device 1, i.e. in the portion between the binding mechanism 3 and the rear end of the gliding device 1. Alternatively, the at least one slot 14 may also extend across the binding mounting portion of the gliding device 1, i.e. continuously from the front end of the gliding device 1 in the direction towards the rear end of the gliding device 1. In this case, in the region of the longitudinal middle portion of the gliding device 1, in particular in its binding mounting portion, this slot 14 extends across only a part-portion of the cross-sectional height of the gliding device 1 so that a groove is formed in the binding mounting portion.

Disposed in at least one end portion but preferably in both end portions of the gliding device 1, the slot 14 extends through all the components of the gliding board body or gliding device 1 in at least one of the end portions of the gliding device 1. In other words, the at least one slot 14 forms a split end portion of the gliding device 1 in at least one of the end portions of the gliding device 1.

The slot 14 therefore defines at least one dovetail-shaped end portion on at least one end of the gliding device 1. This slot or split in the front and/or rear end of the gliding board body results in at least a first and a second gliding board slat 16, 17 at each end portion of the gliding device 1. The first and second gliding board slat 16, 17 are therefore able to move independently relative to one another. This means that the first gliding board slat 16 is largely uncoupled from the second gliding board slat 17 in a static or mechanical respect if one considers only the actual gliding board body, as illustrated by way of example in FIG. 2. This mechanical uncoupling is caused by the slot 14 lying between the first and second gliding board slat 16, 17, which extends from at least one of the outermost ends of the gliding device 1 in the direction towards the longitudinal centre of the gliding device 1. In particular, the slot 14 splits at least one end portion of the gliding device 1 completely, i.e. through its entire cross-sectional height, and the slot 14 also extends to the outermost end of the gliding device 1 forming the dovetail-shaped end portion of the gliding device 1, in particular of the ski 2, defined above.

Figure 5:
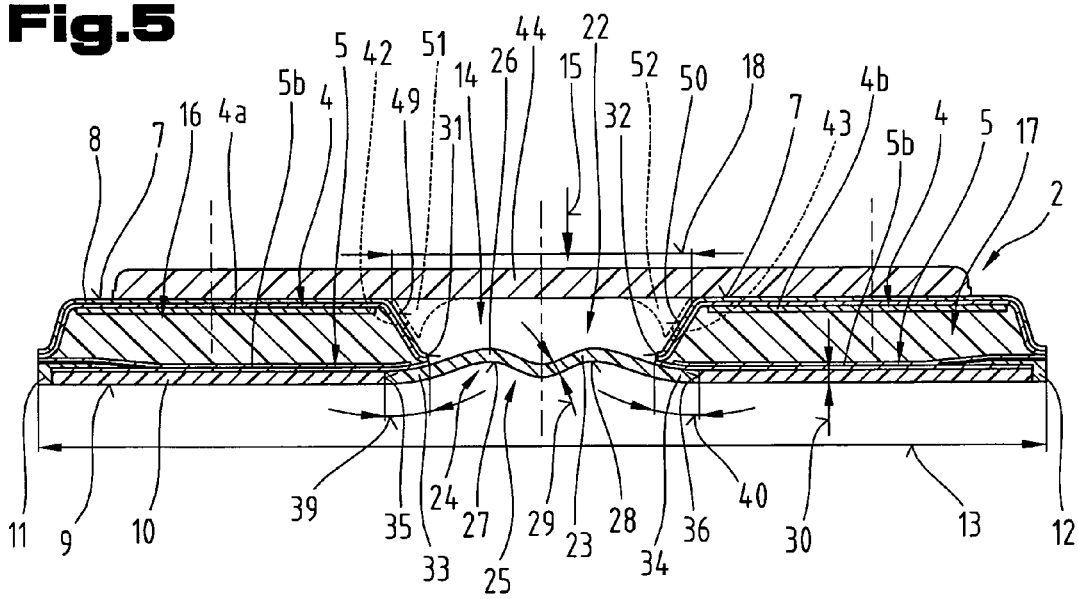
FIG. 5 shows the ski illustrated in FIG. 3, viewed in section along line V-V indicated in FIG. 3.
Figure 6:
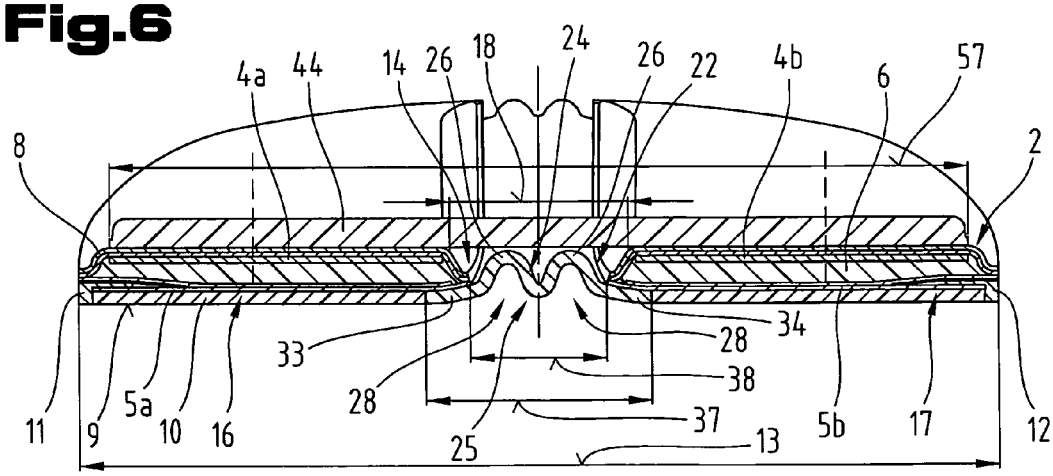
FIG. 6 shows the ski illustrated in FIG. 3, viewed in section along line VI-VI indicated in FIG. 3.

As may be clearly seen from the diagrams shown in FIGS. 5, 6, in terms of the static aspect or strength of the gliding device 1, the at least one slot 14 divides or splits the relevant top belt 4 into a first or left-hand and a second or right-hand top belt strand 4*a* and 4*b* essentially within the longitudinal extension of the slot 14. In other words, due to the presence of the slot 14, the top belt 4 is interrupted or split essentially within the longitudinal portion of the slot 14 and is subdivided into at least two top belt strands 4*a*, 4*b*. The same applies to the bottom belt 5, which is likewise divided or split at least within the longitudinal portion of the slot 14 into a first or left-hand and a second or right-hand bottom belt strand 5*a* and 5*b*. The strength-imparting top belt 4 and also the strength-imparting bottom belt 5 are therefore split or interrupted by means of the longitudinally extending slot 14 so that the transverse stiffness of the gliding device 1 is significantly reduced and in particular, the gliding board slats 16, 17 formed as a result are able to move relative to one another when the gliding device 1 or ski 2 is subjected to edge loads accordingly and/or if an appropriate geometry-influencing means 19 is used, for example a manually pre-settable adjusting means, in particular a prising means 20.

In order to permit an appropriate elastic cross-sectional deformation, in particular a stretching or widening of the cross-sectional width transversely to the longitudinal direction of the gliding device 1 and in the plane extending essentially parallel with its running surface facing 10 when the gliding device 1 is being used under real conditions or load, the slot 14 extends or several slots 14 aligned in a row in the longitudinal direction of the gliding device 1 extend across 40 to 80%, preferably approximately 60%, of the length of the gliding device 1. Alternatively or in combination, the slot 14 disposed at the front end of the gliding board body extends across 50% to 90%, preferably across approximately 75%, of the portion between the binding mechanism 3 and the front end of the gliding device 1.

It is of particular advantage if the slot 14 extends as far as the front shovel portion of the ski 2 and is therefore also disposed in the shovel portion, as illustrated in FIG. 1 for example. In particular, it is of advantage if the slot 14 extends within the front shovel portion continuously as far as the front end of the ski tip. The upwardly curved shovel portion, which has a relatively high transverse strength as a result of this curvature, is decisively influenced as a result in terms of its torsional or transverse stiffness, which enables the requisite stability requirements of such a ski 2 with at least one split end portion to be satisfied on the one hand and enables the desired elastic deformations to occur on the other hand. These elastic deformations can be generated as bending loads are applied to the ski 2 during use and are produced under the effects of adjusting forces of an individually adjustable adjusting means. On average, the respective cross-section influencing means 19 is able to produce changes of up to 6 m in the effective radius of curvature of the ski 2. In particular, it is able to produce a change in the range of several metres in the contour radius of the ski 2 without having to use structurally complex or intensive means and without significantly increasing the weight of the ski 2. Such an adjustment range for the effective radius of curvature which can be achieved with such a ski 2 using its control edges 11, 12 on underlying ground covered with snow is also clearly perceptible or noticeable to users with average ability and users who engage in the sport only occasionally. This increases acceptance of using it and significantly increases the pleasure of using such skis 2.

A width 18 of the slot 14 preferably becomes smaller starting from the top face 7 of the gliding device 1 in the direction towards the running surface facing 10. In other words, the slot 14 is preferably wedge-shaped in the direction towards the running surface facing 10 as viewed in cross-section and the biggest width 18 is disposed in the region merging into the top face 7 of the gliding device 1.

As may also be seen from the diagrams shown in FIGS. 1 and 3 to 6, the board-type gliding device 1 is provided with at least one geometry-influencing means 19 as a means of varying or influencing the cross-sectional geometry of the gliding device 1 in at least one of the end portions of the gliding device 1. In the embodiment illustrated as an example, the geometry-influencing means 19 is provided in the form of a prising means 20, which causes a variation in the width 18 of the slot 14 as the gliding device 1 flexes due to load and thus changes the contour or width 13 of the gliding device 1 within the longitudinal extension of the slot 14 as a function of load. To this end, the prising means 20 is designed so that the two gliding board slats 16, 17 are prised apart from one another transversely to the longitudinal direction of the gliding device 1 and essentially parallel with its running surface facing 10 when the gliding device 1 is subjected to a flexing movement such as will occur above all when turning with the gliding device 1, in particular when performing what is referred to as "carving". The greater the flexing of the gliding device 1 is, the wider the slot 14 will open or the greater the prising angle 21 that will be produced between the longitudinal centre axes of the two adjacently lying gliding board slats 16, 17. The prising means 20 therefore makes at least one end portion of the gliding device 1 wider when the corresponding end portion of the gliding device 1 elastically flexes accordingly about a transverse axis of the gliding device 1, as may clearly be seen from the diagrams of the geometry-influencing means 19 illustrated in FIGS. 1 and 3.

It is of advantage that the at least one slot 14 which splits the strength-imparting components or plies and layers of the gliding device 1 in at least one end portion of the gliding device 1 and thus forms two gliding board slats 16, 17 extending essentially parallel with one another in at least one of the end portions of the gliding device 1 is provided with or faced with an elastically stretchable bridging element 22. This elastically stretchable bridging element 22 is preferably formed by an integral, elastically stretchable and rebounding plastic layer 23, thereby forming a bridging element 22 between the two gliding board slats 16, 17 which varies in width. In particular, the elastically stretchable bridging element 22 is designed so that it can stretch and rebound elastically at least transversely to the longitudinal extension of the slot 14 or gliding device 1. The ability of the bridging element 22 to stretch and rebound is imparted by the intrinsic elastic properties and/or shape of the plastic layer 23 and/or the shape, in particular the cross-sectional shape, of the bridging element 22. In particular, the bridging element 22 or plastic layer 23 may be provided with at least one expansion fold 24 or similar to impart shapes with a varied width, such as a fold-type deflection, arcuate indentation or similar.

The bridging element 22 is also designed so that snow is prevented from getting or being transferred inside the slot 14 from the running surface facing 10 in the direction towards the top face 7 of the gliding device 1. The bridging element 22 therefore fulfils the function of a barrier layer which is able to stretch and rebound elastically, at least the in transverse direction, which also prevents snow or ice from getting to or being transferred between the bottom face 9 and the top face 7 of the gliding device 1 and vice versa. The bridging element 22 may therefore constitute an elastically stretchable intermediate piece of the running surface facing 10, as may be seen in particular from FIGS. 5, 6.

The bridging element 22 for the slot 14 in the running surface facing 10 or in the gliding device 1 therefore has a stretching portion 25 which has a reversibly variable cross-sectional shape and in particular is able to stretch and rebound elastically. If the elasticity of the bridging element 22 is sufficiently high, in particular if the plastic layer 23 is made from an elastomeric or rubber-type material, it is possible to provide a plate-type or flat plastic layer 23 between the two gliding board slats 16, 17.

The bridging element 22 can preferably be reversibly varied in terms of its cross-sectional shape, in particular can be widened and compressed. To this end, the bridging element 22 may be provided with the expansion fold 24 mentioned above. For example, the variable cross-section or stretching portion 25 may be provided in the form of at least one arcuate deflection 26 in the cross-sectional contour of the bridging element 22. In particular, this stretching portion 25 may be provided in the form of an indentation or protuberance in the cross-sectional contour of the bridging element 22, as may best be seen from FIGS. 5 to 9. An apex line 27 or an apex point of the loop-shaped or arcuate deflection 26 or the dome-type shape of the bridging element 22 lies above a gliding surface of the running surface facing 10 formed by the bottom face 9 as viewed in cross-section. The cross-section of the bridging element 22 is preferably selected so that at least one recess 28 is formed, extending substantially parallel with the longitudinal centre axis of the gliding device 1 within the longitudinal extension of the bridging element 22. This recess 28 is formed in the bottom face 9 of the gliding device 1 and thus extends from the gliding surface on the bottom face 9 of the running surface facing 10 at least partially in the direction towards the top face 7 of the gliding device 1.

As may best be seen from FIGS. 5, 6 it may be preferable if the bridging element 22 has two loop-shaped deflections 26 which have an upwardly pointing dome shape as viewed in cross-section and are disposed essentially parallel with one another, extending in the longitudinal direction of the gliding device 1. The bridging element 22 may be made from any material that is as tear-resistant as possible and elastically deformable. The bridging element 22 is preferably made from a strip-shaped plastic layer 23, in particular from an elastomeric plastic, and the bridging element 22 is preferably produced by means of an injection moulding process, thereby enabling the desired profile or cross-sectional shape to be imparted to it. The bridging element 22 may optionally be made from a non-injection moulded plastic, in particular from a textile material. Such a textile or woven fabric is preferably provided with a coating, in particular of elastomeric plastic.

A thickness 29 of the bridging element 22 preferably corresponds to approximately a thickness 30 of the running surface facing 10. Accordingly, a thickness 29 of the bridging element 22 is expediently between 0.1 mm and 2 mm, in particular the thickness 29 of the bridging element 22 is approximately 1 mm.

In addition to having elastic properties, the bridging element 22 should also be as resistant to puncturing and tearing as possible. In particular, the bridging element 22 is of such a robust and tear-resistant design that when the tip of a conventional ski stick is placed on the bridging element 22 and force is applied to the ski stick by a person using the upper body, the bridging element 22 is not punctured. The bridging element 22 is preferably of such a robust and abrasion-resistant design that the performance of the gliding board body will not exhibit wear or abrasion to the degree that its performance would be detrimentally affected for at least five winter seasons of average use of the gliding board body due to frictional movements with respect to snow or ice. The tearing strength of the bridging element 22 is preferably selected so that a stone lying loose on a ski slope can not tear through or tear open the bridging element 22 as the gliding board body, in particular the ski 2, slides across such a stone.

At least the bottom face of the bridging element 22 facing the ground underneath the gliding board body may be provided with a coating which reduces its sliding friction and enhances its capacity to glide over snow or ice. This coating of the bridging element 22 intended to reduce frictional resistance with respect to snow or ice may be a layer of Teflon, gliding wax or similar, all being materials which reduce gliding friction.

The bridging element 22, which is able to stretch and rebound elastically at least in its transverse direction, may also be a layer incorporating several components. In particular, the bridging element 22 may have at least one reinforcing layer and at least one top layer. The bridging element 22 may also be of a transparent or diffuse colored design or permeable to light. The bridging element 22 may be produced by means of a multi-component injection moulding process in order to impart the desired contour and/or in order to form zones with different strength and/or elastic properties, for example. The bridging element 22 may also be provided with color-contrasting zones in a simple manner.

At least in its peripheral portions 33, 34, the bridging element 22 is designed so that a high-strength, adhesively or thermoplastically welded connection is produced with the adjoining layers or plies of the gliding board body.

As may also best be seen from FIGS. 5, 6, the bridging element 22 is preferably made as a separate component. This bridging element 22 is therefore joined to the two gliding board slats 16, 17 via its side peripheral portions 33, 34 extending substantially parallel with the side boundary edges 31, 32 of the slot 14. In particular, the side peripheral portions 33, 34 of the bridging element 22 sit against mutually facing side edges 35, 36 of the running surface facing 10 as far as possible without any gap. A width 37 of the bridging element 22 is preferably bigger than a clearance width 38 of the slot 14 to be bridged. In particular, the side peripheral portions 33, 34 of the bridging element 22 form overlap zones 39, 40 across which the bridging element 22 is positively, in particular adhesively, joined to the gliding board slats 16, 17. This adhesive connection is such that the bridging element 22 merges in these overlap zones 39, 40 or with the outer edges of the side peripheral portions 33, 34 as far as possible leaving no gaps in the running surface facing 10. In particular, gaps should be avoided as far as possible in the transition portion between the bridging element 22 and the running surface facing 10. The bottom face or bottom surface of the bridging element 22 thus lies predominantly, i.e. by more than 80%, above the bottom face 9 of the running surface facing 10 if the gliding device 1 is viewed in cross-section. The bottom face of the bridging element 22 is preferably disposed entirely above the bottom face 9 of the running surface facing 10. At its side peripheral portions 33, 34, the bridging element 22 adjoins the gliding surface or bottom face 9 of the running surface facing 10 in a flush arrangement (FIG. 5). The bridging element 22, which may have properties obtained by a different type of processing than the running surface facing 10, in particular exhibits a different type of behavior with respect to polishing processes, is preferably disposed at least predominantly above—FIGS. 5, 6—or in its entirety but at a distance 41 above—the gliding surface or bottom face 9 of the running surface facing 10 as may best be seen from FIG. 7 or FIG. 8. This offers an effective and inexpensive way of avoiding any impairment to the bridging element 22 with its elastomeric properties during a polishing or any other processing operation carried out on the gliding surface of the running surface facing 10 and it is likewise able to undergo a polishing operation. This avoids any melting and prevents scoring or any other effects with respect to the bridging element 22, in particular its surface. In particular, this avoids the bridging element 22 for the slot 14 being subjected to a surface polishing treatment during production of the gliding device 1 or during the course of subsequent servicing work undertaken on the gliding device 1, in particular during surface polishing work.

Figure 7:
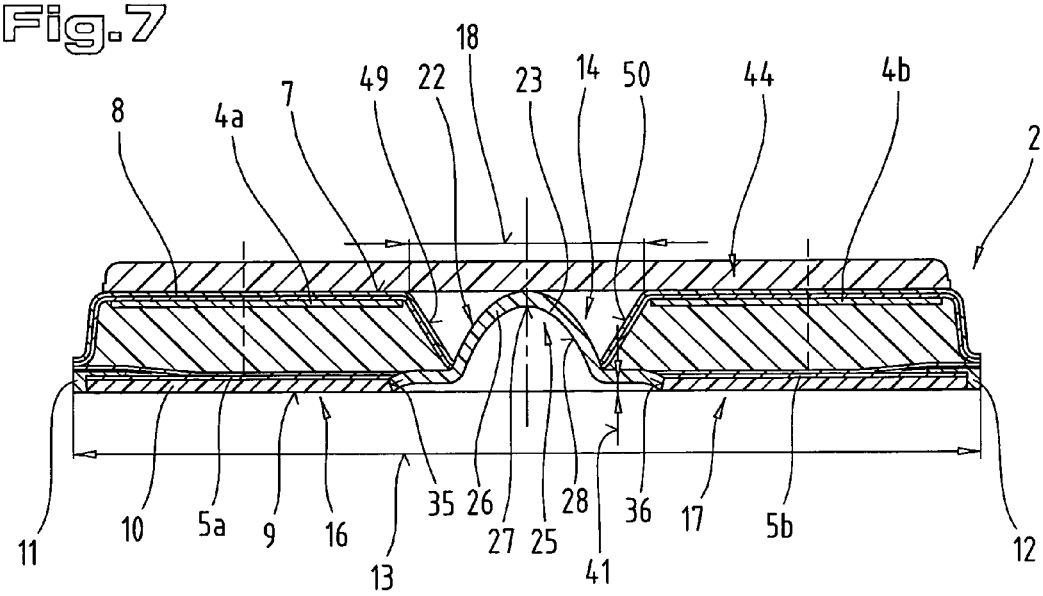
FIG. 7 is a simplified, schematic view in cross-section showing a board-type gliding device with a different embodiment of a bridging element for the slot extending longitudinally down the centre of the gliding board body.
Figure 8:
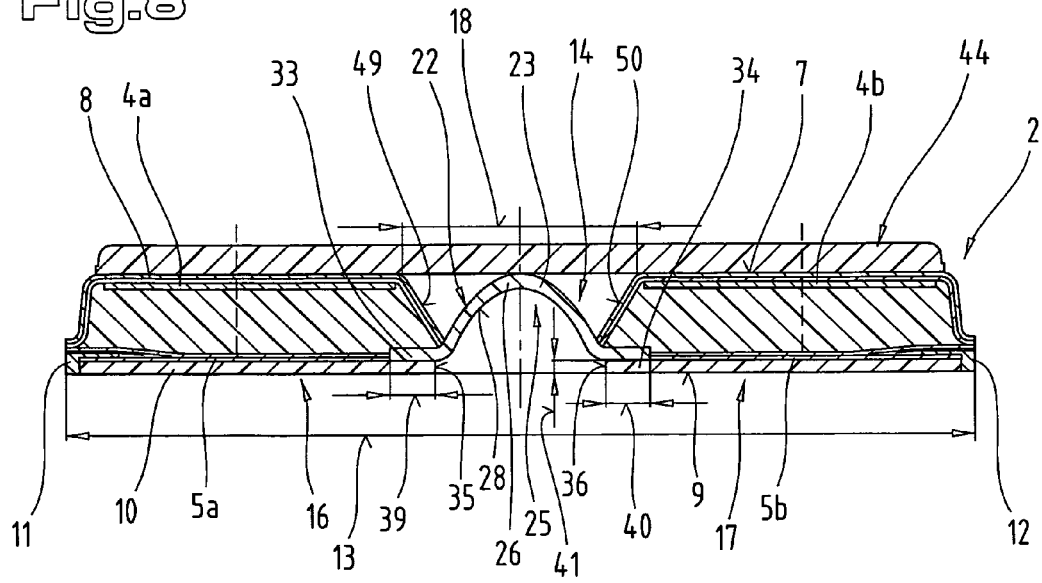
FIG. 8 is a simplified, schematic view in cross-section showing a board-type gliding device with a different embodiment of a bridging element for the slot extending longitudinally down the centre.

The distance 41 between the bottom face 9 or between the gliding surface of the running surface facing 10 and the bottom surface of the bridging element 22 perpendicular to the running surface facing 10 may constitute a butting joint between the inner side edges of the running surface facing 10 and the outer side edges of the bridging element 22, as may be seen from FIG. 7. The transition portion is preferably provided in the form of a rounded region, as may be seen from FIG. 7. Alternatively, it would also be possible to provide a chamfer.

Another option is to provide lateral overlap zones 39, 40 of the bridging element 22 so that these overlap zones 39, 40 are positioned on the side of the running surface facing 10 directed towards the core 6. Within these overlap zones 39, 40, the bridging element 22 is preferably joined to the running surface facing 10 by means of a plastic welded joint. In particular, the overlap zones 39, 40 of the bridging element 22 may be integrally accommodated in the gliding board slats 16, 17 respectively, as may be seen from FIG. 8 for example. The distance 41 in this instance is approximately 0.5 mm to 3 mm. Mutually facing peripheral portions or transition zones of the running surface facing 10 in the direction towards the bridging element 22 may also be provided with a chamfer or rounded region in order to avoid any sharp-edged transitions within the running surface facing 10.

Figure 9:
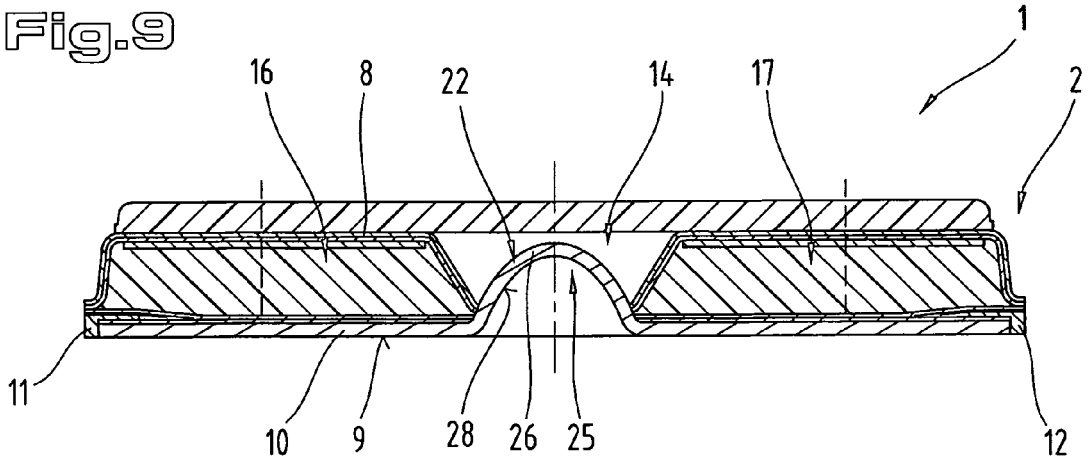
FIG. 9 is a simplified, schematic view in cross-section showing another embodiment of a board-type gliding device, in particular a ski, the side shape of which can be varied.

As illustrated by the embodiment shown in FIG. 9, the bridging element 22 and the running surface facing 10 may be formed by an integral plastic ply or plastic layer, which extends seamlessly and without any interruptions between the two outer edges or control edges 11, 12 of the gliding device 1. In this case, a loop-shaped deflection 26 is provided in the central portion of the running surface facing 10, which is preferably produced by a process of thermal forming in the running surface facing 10 and to this end the latter is made from a heat-deformable plastic or incorporates elements made from a heat-deformable plastic.

Figure 2:
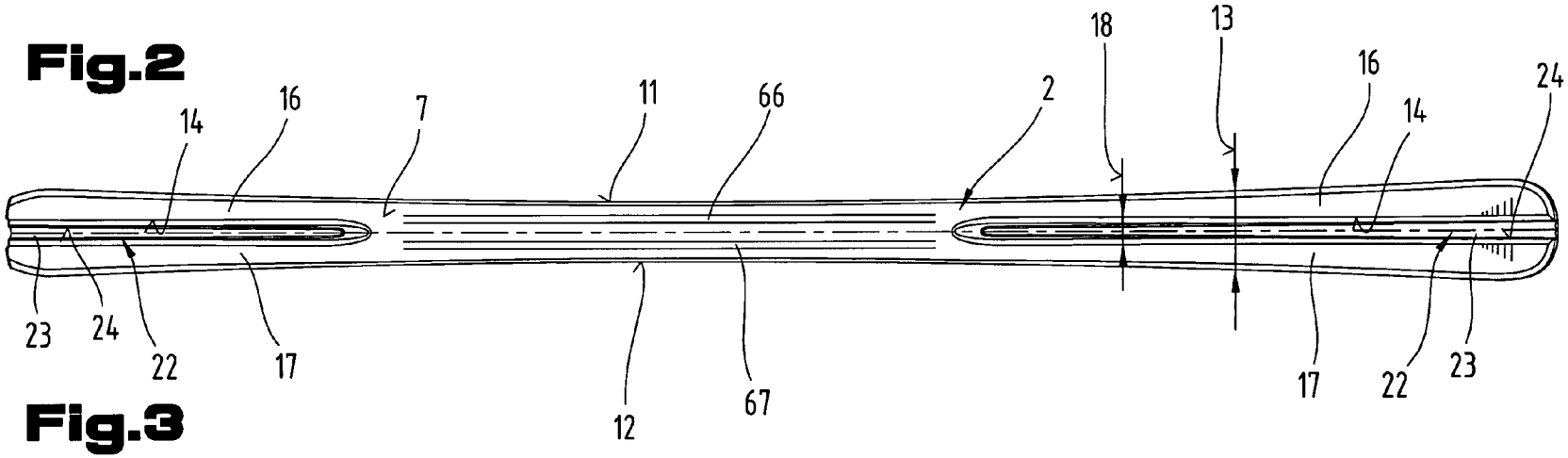
FIG. 2 is a simplified, schematic plan view showing the gliding board body illustrated in FIG. 1 without the geometry-influencing means.
Figure 3:
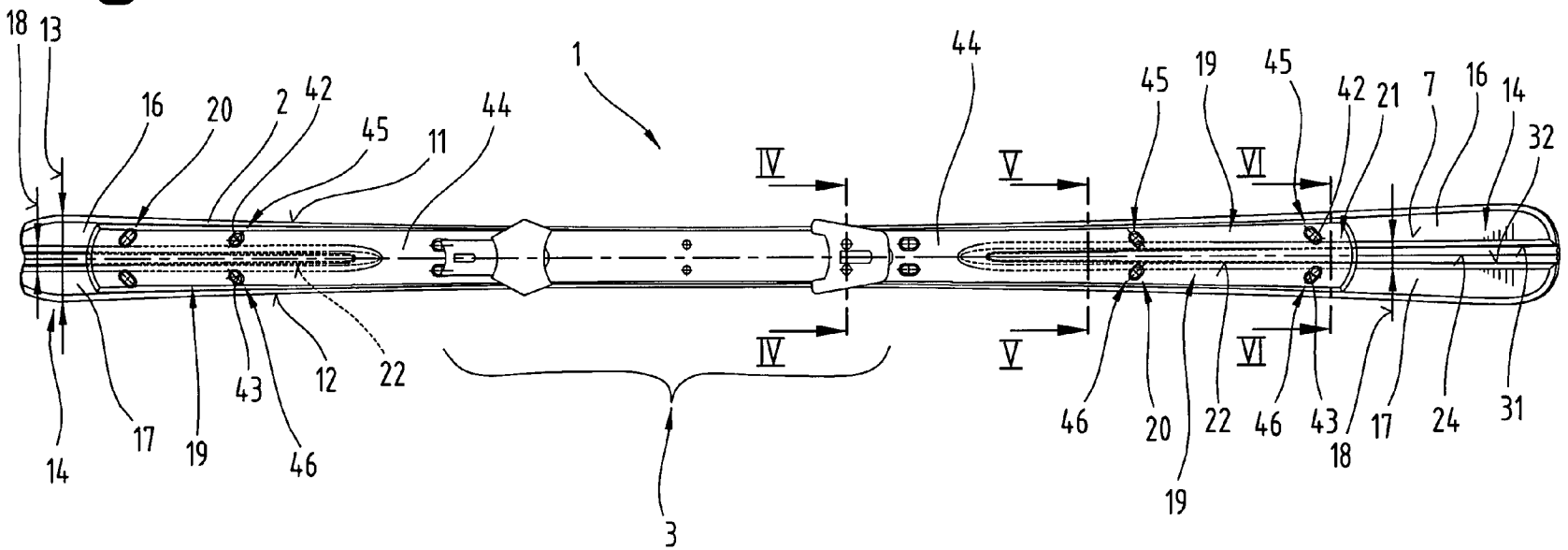
FIG. 3 shows a ski similar to that of FIG. 1 viewed from above.

As may best be seen from FIGS. 1 to 3, it is of advantage if, by reference to the oppositely lying ends of the gliding board body in the longitudinal direction, a front or first slot 14 and a rear or second slot 14 is provided. In particular, the front slot 14 extends from a front end portion of the binding mounting portion, or from the vicinity of the mounting portion for the binding mechanism 3, in the direction, towards the front end, in particular through to the shovel portion of the gliding board body. The rear slot 14 extends from a rear end portion of the binding mounting portions, or from the vicinity of the mounting portion for the binding mechanism 3, in the direction, towards the rear end, in particular as far as the rearmost end point of the gliding board body. At least the mounting portion for the binding mechanism 3 and optionally the zones adjoining it are not slotted. In the binding mounting zone, the slot 14 may optionally merge into a groove formed in the top face 7 of the gliding board body. If the gliding board body is viewed from above, this therefore results in an essentially X-shaped structure, as may best be seen from FIG. 2.

It is preferable if both the front slot 14 and the rear slot 14 of the gliding board body are provided with at least one geometry-influencing means 19, as may be seen from the diagrams shown in FIGS. 1 and 3. This makes it possible to vary or exert a pronounced influence on the so-called side-cut or contour radius and the travel behavior of the gliding board body.

The bridging element 22 is preferably designed, in particular shaped and/or of an elastic design so that, in an end portion lying closest to the end of the gliding board body, it effects an elastic extension of at least 10 mm in terms of its width 37 without being subjected to damage. In other words, an elastic stretching and rebounding action of the bridging element 22 of 10 mm at its end remote from the binding mounting portion will not cause damage, in particular will not lead to tearing, breakage or overstretching of the bridging element 22.

The geometry-influencing means 19 co-operating with the slotted end portions of the gliding board body may be designed so that a width 18 of the slot 14 can be varied and individually pre-set to enable the travel or turning behavior of the gliding board body to be adapted to suit the individual wishes or requirements of the user to the best possible degree. Alternatively or in combination, the geometry-influencing means 19 may also be designed so that it causes a variability in the width 18 of the slot 14 as a function of load or flexing of the gliding board body, as explained above. The geometry-influencing means 19 preferably has at least one prising means 20 for providing an individually adjustable variation or a variation dependent on load in the width 18 of the slot 14.

As may best be seen from FIGS. 1 and 3, the prising means 20 has, by reference to a plane extending essentially parallel with the running surface facing 10, at least two support or guide surfaces 42, 43 extending at an angle with respect to the longitudinal axis of the gliding board body. By reference to the longitudinal centre axis of the gliding board body, these support or guide surfaces 42 are disposed in a V-shape with respect to one another and the longitudinal centre axis of the gliding board body constitutes a bisecting straight line. In particular, the angle subtended between two obliquely extending support or guide surfaces 42, 43 is essentially bisected by the imaginary longitudinal axis of the gliding board body, as may best be seen from FIG. 3. These support or guide surfaces 42, 43 are preferably disposed in a plate-type force-transmitting element 44 and due to their orientation extending at an angle relative to the longitudinal axis of the gliding board body produce a wedging or prising effect with respect to the slotted portion(s) of the gliding board body. It is preferable to provide several pairs of support or guide surfaces 42, 43 spaced at a distance apart from one another in the longitudinal direction of the gliding board body or force-transmitting element 44.

This plate-type force-transmitting element 44 is supported on the top face 7 of the gliding board body and is retained on the gliding board body in at least one of its end portions so that it is able to move relative to its top face 7. The support or guide surfaces 42, 43 of the force-transmitting element 44 oriented in a V-shape with respect to one another are preferably provided in the form of elongate holes 45, 46 extending at an angle with respect to the longitudinal centre axis of the force-transmitting element 44, the walls of which constitute the support or guide surfaces 42, 43. Via these elongate holes 45, 46 and by means of appropriate screw means, the force-transmitting element 44 is connected to the gliding board body, in particular to its top face 7, and retained so that it is able to effect relative movements, and at least one of the ends of the force-transmitting element 44 is still capable of moving in the longitudinal direction relative to the gliding board body. The latter is joined to the top face 7 of the gliding board body so that it is fixed in all directions, preferably in the middle portion of the force-transmitting element 44. This may be achieved using circular bores and appropriate screw means, as schematically illustrated in FIG. 1.

The support or guide surfaces 42, 43 in or on the plate-type force-transmitting element 44 co-operate with thrust surfaces 47, 48 on the top face 7 of the gliding board body. Alternatively, the obliquely extending support or guide surfaces 42, 43 of the force-transmitting element 44 may also co-operate with mutually facing inner longitudinal side walls 49, 50 of the slot 14, as indicated by broken lines in FIG. 5 for example. In particular, projections 51, 52 are provided on the bottom face of the force-transmitting element 44, as indicated by broken lines. These projections 51, 52 extending parallel with or at an angle with respect to the longitudinal centre axis of the gliding board body may co-operate with thrust surfaces 47, 48 in the slot 14 or in the peripheral portions of the slot 14 extending at an angle with respect to the longitudinal centre axis of the gliding board body, thereby forming the prising means 20. However, the thrust surfaces 47, 48 may also be formed by projections 53, 54 fixedly joined to the top face 7 of the gliding board body, in particular by means of screws 55, 56 or their screw heads.

The preferably plate-shaped force-transmitting element 44 incorporating the support or guide surfaces 42, 43 or incorporating the obliquely positioned elongate holes 45, 46 extends across more than 50% of the length of the gliding board body in the case of the embodiment illustrated in FIG. 1. In particular, the ends of the plate-type force-transmitting element 44 overlap with the slots 14 in the gliding board body. In particular, the two end portions of the force-transmitting element 44 overlap with at least part-portions of the two slots 14 at the terminal ends the gliding board body when the force-transmitting element 44 is placed on the top face 7 of the gliding board body, as may best be seen from FIG. 3. The plate-type force-transmitting element 44 is also designed and in particular its width 57 is dimensioned so that the plate-type force-transmitting element 44 bridges the at least one slot 14 transversely to its longitudinal direction, in particular transversely to the longitudinal direction of the gliding board body. This means that the plate-type force-transmitting element 44 has a width 57 in at least one of its end portions, i.e. in an end portion overlapping the slot 14, the size of which is sufficient to bridge the slot 14. In particular, the end portion of the plate-type force-transmitting element 44 at least partially overlapping the slot 14 is supported firstly on the left-hand and secondly on the right-hand gliding board slat 16, 17 of the gliding board body, as may best be seen from FIGS. 1, 3, 5 and 6. This advantageously prevents the gliding board slats 16, 17 formed on either side of the slot 14 from mutually moving apart from one another to too high a degree in the vertical direction towards the bottom face 9 of the running surface facing 10 or varying in their height position relative to one another. In particular, the plate-type force-transmitting element 44 supports the two gliding board slats 16, 17 in the vertical direction towards the bottom face 9 of the running surface facing 10 and therefore suppresses or limits any vertical lifting or deviation when the gliding board slats 16; 17 are subjected to load during turning as compared with the gliding board slats 16 or 17 when free of load. This is primarily achieved due to the fact that in its end portion facing the slot 14, the plate-type force-transmitting element 44 affords an increasing bending stiffness or a higher torsional stiffness than the gliding board slats 16, 17 or the gliding board body itself in its slotted end portion. Alternatively or in combination, this may be achieved due to the fact that the surmounting and mechanical coupling between the plate-type force-transmitting element 44 and the gliding board slats 16, 17 in total afford an increased bending stiffness or torsional stiffness for the gliding board slats 16, 17 or the assembled gliding board body. In addition to the function of forming a prising means 20 for opening up at least one of the ends of the gliding board body, the bridging of the slot 14 by means of the plate-type force-transmitting element 44 also fulfils a stabilizing function for the relatively flexible gliding board slats 16, 17 produced in the direction perpendicular to the running surface facing 10 due to the slot 14.

The distal ends of the force-transmitting element 44 are therefore still able to move relative to the top face 7 of the gliding board body in its longitudinal direction so that relative displacements between the force-transmitting element 44 and the gliding board body will cause a prising open or narrowing of the slot 14 in the gliding board body, thereby constituting the geometry-influencing means 19.

Looking down onto the top face 7 of the gliding board body, the at least one slot 14 has a length of between 20 cm and 100 cm in at least one end portion of the gliding board body. A width 18 or a clearance width 38 of the slot 14 within its longitudinal middle portion is between 10 mm and 20 mm. These dimensions primarily enable a sufficiently pronounced change in the geometry of the gliding device 1 to be produced without reducing the stability or practical suitability and robustness of the gliding device 1 to critical or unsatisfactory values.

As may best be seen from FIG. 5, the top layer 8 of the gliding board body is preferably provided in the form of a plastic layer which is decorated on at least one side. This top layer 8 constitutes the predominant part-portion of the top face 7 of the gliding board body. This top layer 8 preferably also lines at least part-portions of the mutually facing longitudinal side walls 49, 50 of the slot 14, as may best be seen from FIGS. 5, 6.

The plate-type force-transmitting element 44 is supported within its longitudinal extension, in at least part-portions, on the top face 7 of the gliding board body and transmits loads or forces. In the embodiment illustrated, the bottom face of the plate-type force-transmitting element 44 is supported on the top face 7 of the gliding board body by virtually its entire surface. Alternatively, it would also be possible to provide individually disposed support zones on the bottom face of the plate-type force-transmitting element 44 for the top face 7 of the gliding board body. This being the case, the support zones in at least the end portions of the force-transmitting element 44 are positioned so that the plate-type force-transmitting element 44 is supported on at least the gliding board slats 16, 17 so as to transmit loads and forces.

In order to produce advantageous effects, it is expedient if the plate-type force-transmitting element 44 extends from a binding mounting centre point 58, provided by the manufacturer of the gliding board body, across more than 50% of the length as far as the rear end of the gliding board body and at the same time extends across more than 50% of the length as far as the front end of the gliding board body. It is of advantage if the force-transmitting element 44 extends across approximately 51% to approximately 96%, preferably across 66% to 86%, of the projected length of the gliding board body. It is of advantage if the force-transmitting element 13 extends across approximately 51% to approximately 96%, preferably across 66% to 86%, of the projected length of the gliding board body. By projected length is meant the length of the gliding board body as viewed from above. The longitudinal extension of the plate-type force-transmitting element 44 is essentially limited by the fact that the plate-type force-transmitting element 44 should not extend into the upwardly curved shovel portion or end portion of the gliding board body so that it does not pose an obstacle to the relative movements between the ends of the plate-type force-transmitting element 44 and the gliding board body when this leaf spring-type packet comprising force-transmitting element 44 and gliding board body is subjected to a downward flexing or a lifting of the binding mounting portion or middle portions relative to the end portions. In particular, the upwardly curved shovel portion of the gliding board body would constitute a block with respect to the terminal end of the plate-type force-transmitting element 44 or inhibiting forces would occur if the plate-type force-transmitting element 44 were to extend in a straight line or also in an upwardly cambered arrangement into the shovel portion of the gliding board body. Especially if the plate-type force-transmitting element 44 extends across approximately two thirds to approximately nine tenths, for example across approximately three quarters, of the length of the gliding board body between the binding mounting centre point 58 and the respective end of the gliding board body or by reference to the total length of the gliding board body, a good ratio can be achieved between weight optimization and the stability or functionality of the gliding device 1 as a whole.

As may best be seen from FIGS. 1 and 3, the plate-type force-transmitting element 44 acts as a support for transmitting load, in particular for mounting a binding mechanism 3 for a user's shoe. In particular, a binding mechanism 3 is attached to the top face of the plate-type force-transmitting element 44 in a known manner. In a known manner, the binding mechanism 3 may comprise a front jaw and a heel jaw, which are connected to the top face of the plate-type force-transmitting element 44 either directly or via an interconnected guide rail arrangement. In order to connect the jaw bodies or the rail arrangement of the binding mechanism 3 to the top face of the force-transmitting element 44, at least one screw means 59, 60 is provided. In particular, an adequate connection can be achieved between the force-transmitting element 44 and the binding mechanism 3 by means of this least one screw means 59, 60, preventing any tearing out. The binding mechanism 3 is therefore supported with respect to the actual gliding board body with the plate-type force-transmitting element 44 connected in between.

As may best be seen by comparing FIGS. 1 and 4, it is expedient to provide at least one positively acting coupling means 62, 63 between the bottom face 61 of the plate-type force-transmitting element 44 and the top face 7 of the gliding board body. These positively acting coupling means 62, 63 between the bottom face 61 of the plate-type force-transmitting elements 44 and the top face 7 of the gliding board body, which are preferably disposed in pairs, extend essentially within a mounting zone for the binding mechanism 3, as may best be seen from FIG. 1. Within this mounting zone for a binding mechanism 3, the board-type gliding board body has its biggest thickness or width, as may be seen from FIG. 4, thereby enabling a sufficiently strong mutual positive connection or engagement between the plate-type force-transmitting element 44 and the gliding board body, as illustrated by way of example in FIG. 4.

The positively acting coupling means 62, 63 is designed so that it permits relative movements between the force-transmitting element 44 and the gliding board body in the longitudinal direction of the gliding board body to compensate for longitudinal movements when the gliding board body and the plate-type force-transmitting element 44 are subjected to flexing, as would be the case when travelling over mounds, for example. On the other hand, the positively acting coupling means 62, 63 is designed to prevent relative movements between the force-transmitting element 44 and the gliding board body in the transverse direction with respect to the longitudinal extension and essentially parallel with the running surface facing 10 of the gliding board body as far as possible and affords increased resistance against any such shifting tendencies. In other words, the at least one positively acting coupling means 62, 63 permits relative movements between the plate-type force-transmitting element 44 and the gliding board body in the longitudinal direction of the gliding board body but prevents lateral shifting movements between the plate-type force-transmitting element 44 and the top face 7 of the gliding board body, as may clearly be seen by comparing FIGS. 1 and 4. This partially positively acting connection between the plate-type force-transmitting elements 44 and the gliding board body is therefore conducive to achieving as direct and delay-free a transmission of forces as possible between the force-transmitting element 44 and the gliding board body without the bending behavior of the gliding board body being impaired by the plate-type force-transmitting element 44.

The positively acting coupling means 62, 63 is preferably designed with at least one projection 64, 65, which may be of the stud-type or the strip-type, on the bottom face 61 of the force-transmitting element 44, which locates in a co-operating or complementary recess 66, 67 in the top face 7 of the gliding board body and improves the mechanical coupling between said components. However, the at least one but preferably two rows of projections 64, 65 on the bottom face 61 of the force-transmitting element 44 may also serve as a means of accommodating the front portion, in particular the tip portion 68, of the screw means 59, 60 for attaching the binding mechanism 3 to the plate-type force-transmitting element 44. In particular, the front end or tip portion 68 of a screw means 59, 60 anchored in the force-transmitting element 44 for securing the binding mechanism 3 lies within these projections 64, 65 on the bottom face 61 of the force-transmitting element 44. Above all, this provides a relatively strong anchoring for the screw means 59, 60, preventing them from being torn out, and hence a particularly reliable and strong enough connection for the binding mechanism 3 and its layered arrangement to the plate-type force-transmitting element 44 to prevent it from being torn out. The screw means 59, 60 described above, the tip portions 68 of which extend into the material of the projections 64, 65, may also be provided as a means of securing guide elements, in particular guide rails or so-called binding plates for the jaw bodies of the binding mechanism 3. The essential aspect is that a relatively long anchoring or screwing length exists within the plate-type force-transmitting element 44 if the at least one projection 64, 65 on the bottom face 61 of the force-transmitting element 44 is also advantageously used to increase the screwing-in depth for the screw means 59, 60, as may best be seen from FIG. 4.

As may best be seen by comparing FIGS. 1, 2 and 4, a profile height 69 of the at least one projection 64, 65, preferably of the strip-type, becomes smaller starting from the binding mounting center point 58 in the direction towards the rear and front end of the gliding board body continuously or in steps and preferably diminishes to zero. Similarly, a receiving depth 70 of the at least one, preferably groove-type recess 66, 67 becomes smaller starting from the binding mounting center point 58 in the direction towards the rear and front ends of the gliding board body continuously or in steps and preferably also diminishes to zero. In other words, the at least one recess 66, 67 and the at least one projection 64, 65 co-operating with it extend out from the binding mounting center point 58 in the direction towards the distal ends of the gliding board body and the plate-type force-transmitting element 44 and terminate before the ends of the gliding board body. For example, these projections 64, 65 become gradually flatter with respect to the bottom face 61 of the plate-type force-transmitting element 44, the greater distance they are away from the binding mounting center point 58, and finally disappear altogether. However, the projections 64, 65 and/or the recesses 66, 67 co-operating with them may also terminate with a step. As may best be seen from FIGS. 1 and 2, the at least one recess 66, 67 in the top face 7 of the gliding board body disappears directly in front of the gliding board slats 16, 17 or in front of the slot(s) 14. The oppositely lying end portions of the recesses 66, 67 therefore merge in a flat or flush arrangement into the top face 7 of the gliding board body, as may be seen in particular from the perspective diagram show in FIG. 1. The gliding board body therefore has the groove-type recesses 66, 67 in its middle portion in which the gliding board body has a sufficient or relatively large depth or thickness. At an increasing distance towards the binding mounting center point 58, which is where the gliding board body usually has the biggest thickness or is at its thickest, the recesses 66, 67 will therefore have the biggest receiving depth 70, whereas the receiving depth 70 becomes continuously shorter towards the end portions of the gliding board body or reduces in steps and finally preferably diminishes to zero.

The essential thing is that the screw means 59, 60 for fixing the binding mechanism 3 are anchored solely within the plate-type force-transmitting element 44 and are not anchored in the gliding board body or screwed into the gliding board body disposed underneath. The ability of the plate-type force-transmitting element 44 and the gliding board body to move relative to one another is therefore maintained when said components flex about an axis extending transversely to its longitudinal direction. As schematically illustrated in FIG. 4, these screw means 59, 60 may also be used indirectly to secure the binding mechanism 3 and in particular the interconnected binding plate or a guide rail arrangement for the jaw bodies of the binding mechanism 3 on the plate-type force-transmitting element 44, preventing it from being torn off. In particular, it is expedient if the profiled height 69 of the projection 64, 65 and a plate height 82 of the plate-type force-transmitting element 44 are at least the same as or bigger than a screwing-in depth 83 of the screw means 59, 60 for securing the binding mechanism 3 and its components. As a result, the binding mechanism 3 or a requisite component of the binding mechanism 3 is firmly connected exclusively to the plate-type force-transmitting element 44 without being directly or indirectly screwed to the gliding board body.

Figure 10:
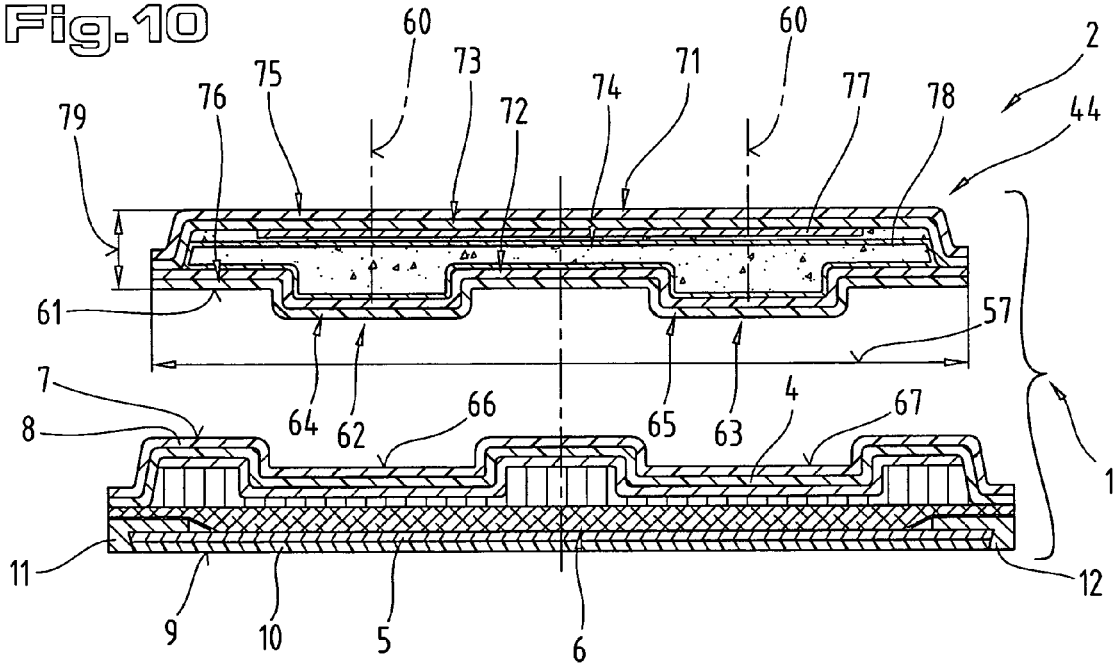
FIG. 10 is a simplified, schematic exploded diagram in cross-section showing a plate-type force-transmitting element and a gliding board body.

FIG. 10 is an exploded diagram providing a simplified, schematic illustration of an example of a different embodiment based on a combination of a board-type gliding body and a plate-type force-transmitting element 44 supported on it. The same reference numbers are used for parts described above and the descriptions given above apply to parts bearing the same reference numbers.

As clearly illustrated, in a manner similar to the gliding board body, the plate-type force-transmitting element 44 constituting an integral part of the geometry-influencing means 19—FIG. 1—is also provided in the form of a multi-layered composite body 71, in particular as a so-called sandwich compound element. In other words, the plate-type force-transmitting element 44 is made up of a plurality of layers adhesively joined to one another and, like the actual gliding board body, is produced by means of a hot press by a heat processing method of a known type used to make skis and snowboards or similar.

In particular, in its function as the geometry-influencing means 19—FIG. 1—the plate-type force-transmitting element 44 comprises at least one strength-imparting bottom belt 72, at least one strength-imparting top belt 73, at least one core element 74 disposed in between and at least one top layer 75 decorated on one side or intended to be decorated on top of the strength-imparting top belt 73. The bottom face 61 of the plate-type force-transmitting element 44 is preferably formed by a gliding layer 76 made from plastic. This gliding layer 76 has a lower or the lowest possible frictional resistance compared with the top face 7 of the top layer 8 of the gliding board body. Compared with the top layer 8, the gliding layer 76 is as abrasion-resistant as possible. The gliding layer 76 on the bottom face 61 of the plate-type force-transmitting element 44 may be made from a heat-deformable plastic layer with properties similar to those of the top face or top layer 8 of the gliding board body and similar properties to those of the running surface facing 10 of the gliding board body.

A thickness of the gliding layer 76 of the plate-type load and force-transmitting element 44 is between 0.1 and 2 mm, preferably approximately 0.4 mm. In order to produce visual contrasts, the gliding layer 76 is preferably colored. Like the running surface facing 10 of the gliding board body, the gliding layer 76 of the plate-type force-transmitting element 44 preferably also extends across the entire width 57 of the plate-type force-transmitting element 44, as illustrated by way of example in FIG. 10. Also with regard to the longitudinal extension of the plate-type force-transmitting element 44, the gliding layer 76 preferably extends across the entire length of the force-transmitting element 44. In particular, the gliding layer 76 forms the bottom termination of the force-transmitting element 44 as it were, so that at least a major part of the bottom face 61 of the force-transmitting element 44 is formed by the gliding layer 76.

At least the predominant number of individual layers or elements of the multi-layered plate-type force-transmitting element 44 are formed and joined by means of a heat press, in particular in at least one heat pressing operation for the various layers and elements placed in a heatable pressing mould, in order to produce an integral, multi-layered composite body 71.

The at least one bottom belt 72 imparting strength and/or the at least one top belt 73 imparting strength incorporates at least one layer made from a so-called prepreg, i.e. a layer comprising a fabric impregnated with a plastic resin which melts when heated, for example a glass fibre fabric. The top belt 73 may also have an additional binding anchoring layer 77. This binding anchoring layer 77 extends essentially within a part-portion of the force-transmitting element 44 where the binding mechanism 3 will subsequently be secured by screw means 59, 60—FIGS. 1 and 10—directly or indirectly via guide rails or so-called binding support plates on the force-transmitting element 44. In addition to the prepreg layers imparting strength and stiffness, the bottom and/or top belt 72, 73 of the plate-type force-transmitting element 44 may also contain metal layers and/or strength-enhancing plastic layers, in a manner known from many designs which exist in the prior art.

The core element 74 of the plate-type force-transmitting element 44 may be made from an at least partially prefabricated element of hard foamed plastic and/or from wood, for example. The core element 74 may optionally be surrounded, at least in certain portions, by a hose-type sleeve 78 designed to improve the adhesive connection to the surrounding layers.

The sandwich-type structure of the multi-layered composite body 71 results in a plate-type force-transmitting element 44 with a relatively high torsional as well as shearing strength.

The torsional or twisting strength of the plate-type force-transmitting element 44 is so high that when subjected to loads on only one of the two gliding board slats 16, 17—FIG. 1—during travel mode, a height offset between the two gliding board slats 16, 17 in the direction perpendicular to the running surface facing 10 is specifically at least inhibited respectively reduced or prevented by the plate-type force-transmitting element 44. In other words, the plate-type force-transmitting element 44 affords increased resistance to prevent a parting of the two gliding board slats 16, 17 in the direction perpendicular to the running surface facing 10 and as far as possible prevents such height variations occurring between the two gliding board slats 16, 17 at least once they have reached a certain extent. In particular, the plate-type force-transmitting element 44, which extends across at least certain portions of the two gliding board slats 16, 17—FIG. 1—and transmits loads, prevents one of the two gliding board slats 16; 17 from flexing or deforming significantly more than the other gliding board slat 16 or 17. In particular, the degree of deformation in the gliding board slats 16; 17 under load during turning 16; 17 is more or less the same as the degree of deformation of the gliding board slats 16 or 17 when not placed under load. This is primarily due to the plate-type force-transmitting element 44, which is supported via the two gliding board slats 16, 17 transmitting load, as may be seen from FIG. 1 or 3 for example. This force-transmitting element 44 therefore ensures that a relatively uniform deformation occurs between the force-transmitting element 44 and the gliding board slats 16, 17 at least within the overlap region, in particular a flexing of the two gliding board slats 16, 17. The plate-type force-transmitting element 44 to a large degree contributes to the bending behavior and the distribution of bending stiffness of an assembled, ready-to-use gliding device 1, in particular an alpine or carving ski 2 designed accordingly.

A mean height or thickness 79 of the plate-type force-transmitting element 44 is between 0.5 and 3 cm. In particular, the thickness 79 of the multi-layered, plate-type force-transmitting element 44 is between 50% and 150% of the thickness of the gliding board body within the binding mounting zone. In the case of the advantageous embodiment illustrated in FIG. 10, the height or thickness 79 of the plate-type force-transmitting element 44 corresponds to approximately the height or thickness of the gliding board body within the same cross-sectional plane, in particular within the binding mounting zone. The total thickness or total height of the gliding device 1 comprising the assembled plate-type force-transmitting element 44 assembled with the actual gliding board body within the binding mounting zone is at most 5 cm, preferably 2 to 3 cm, as illustrated by way of example in FIG. 10. This relatively low height of the gliding device 1 and its strength or stiffness, which nevertheless satisfy practical requirements, are obtained due to a multi-layered, plate-type load-transmitting body, in particular by means of the plate-type force-transmitting element 44, which is coupled with the actual gliding board body by a least one positively acting coupling means 62, 63 in a conforming arrangement.

When the gliding device 1 is in the operation-ready state—FIG. 3—a binding mechanism 3 is mounted on the top face of the plate-type force-transmitting element 44. The screw means 59, 60—FIG. 1—for directly or indirectly retaining the binding mechanism 3 are anchored exclusively in the plate-type force-transmitting element 44. The plate-type force-transmitting element 44 is in turn connected by separately provided screw means in the region of the binding mounting zone but preferably on or close to the binding mounting centre point 58—see FIG. 1—so that it is as rigid as possible in all directions and firmly connected to the actual gliding board body. In particular, the plate-type force-transmitting element 44 is connected to the gliding board body rigidly or so that it can not move in the region of the binding mounting centre point 58 by means of at least one screw, as schematically illustrated in FIG. 1. At the oppositely lying end portions, which are mounted so that they are able to slide freely relative to the gliding board body disposed underneath, however, the plate-type force-transmitting element 44 is provided in the form of at least one geometry-influencing means 19, which is able to prise or open at least one end portions of the gliding board body.

As also schematically illustrated in FIG. 1, the plate-type force-transmitting element 44 is connected to the gliding board body by means of a plurality of screw means spaced at a distance apart from one another in the longitudinal direction so that the plate-type force-transmitting element 44 is prevented from lifting off or detaching from the top face 7 of the gliding board body. In particular, screw means may also be provided in the immediate vicinity of the jaw bodies of the binding mechanism 3, which connect the plate-type force-transmitting element 44 to the gliding board body lying underneath via elongate holes oriented parallel with the longitudinal direction of the force-transmitting element 44 so that different bending or chord lengths between said components can be compensated as far as possible unhindered.

As may be clearly seen from the diagram shown in FIG. 1, the gliding device 1 comprises at least two components supporting the user, in particular the plate-type force-transmitting element 44 and the gliding board body disposed underneath. The board-type gliding device 1 is therefore made up of at least two or more parts and said components are coupled with one another by means of positive connections and/or screw connections.

The plate-type force-transmitting element 44 may expediently be thicker in the part-portion of the geometry-influencing means 19 by integrating or applying at least one reinforcing layer for example, as schematically indicated by broken lines in FIG. 1. Such a reinforcing layer is primarily of advantage in the immediate vicinity of the prising means 20 and around the elongate holes 45, 56, in which case the reinforcing layer preferably extends through the elongate holes 45, 46.

Figure 11:
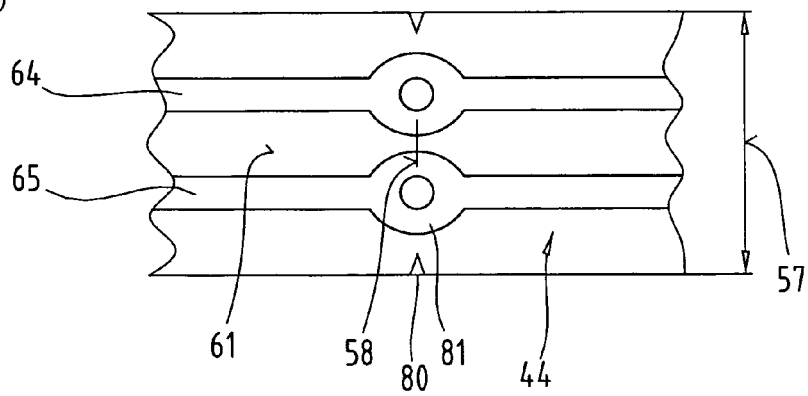
FIG. 11 is a simplified diagram showing a part-portion of the bottom face of a plate-type force-transmitting element.

FIG. 11 schematically illustrates an example of the bottom face 61 of the plate-type force-transmitting element 44 in the region of the binding mounting centre point 58.

Extending parallel with one another on the bottom face 61 of the plate-type force-transmitting element 44 are two projections 64, 65 that are strip-shaped, which locate in approximately complementary recesses 66, 67—FIG. 10—in the top face 7 of a gliding board body, as briefly described above. By reference to the longitudinal direction of the plate-type force-transmitting element 44, the plate-type force-transmitting element 44 has preferably only one fixing point 80 or as short as possible a fixing zone relative to the gliding board body lying underneath. This fixing point 80 or this fixing zone is preferably positioned close to the binding mounting center point 58. At this fixing point 80 or within this narrow fixing zone, the plate-type force-transmitting element 44 can be connected to the gliding board body, preferably by screw means, so that it is largely inflexible or rigid in all directions. At this fixing point 80, therefore, all relative movements between the plate-type force-transmitting element 44 and the gliding board body are prevented. At an increasing distance from this fixing point 80, however, increasingly large relative movements are possible between the plate-type force-transmitting element 44 and the gliding board body when these components are subjected to bending or flexing.

At least one thicker region 81 or at least one narrower region may be provided at this fixing point 80 or as close as possible to this fixing point 80 on the bottom face 61 of the plate-type force-transmitting element 44, which can be positively coupled with a co-operating recess or raised area on the top face of the gliding board body. As a result, forces directed in the longitudinal direction of the force-transmitting element 44 with respect to the gliding board body can be better absorbed. In particular, it is of practical advantage to establish a positive connection in the region of the fixing point 80 by means of co-operating recesses or raised areas, which reliably prevents any relative movements between the force-transmitting element 44 and the gliding board body. Another advantage resides in the fact that the plate-type force-transmitting element 44 can simply be placed on the top face of the gliding board body during assembly and also positioned flat in the longitudinal direction, thereby simplifying the process of connecting or screwing said components during assembly. Another advantage of this positively acting connection resides in the fact that longitudinal forces or shearing or shifting forces can be partially absorbed by this positively acting connection and the entire load does not have to be absorbed by the screw-type fixing means. This means that the number of screw-type fixing means can be reduced or smaller ones can be used.

The embodiments illustrated as examples represent possible design variants of the board-type gliding device 1 and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the gliding board body, it and its constituent parts are illustrated to a certain extent out of scale and/or on an enlarged scale and/or on a reduced scale.

Above all, the individual embodiments of the subject matter illustrated in FIGS. 1, 2, 3, 4, 5, 6; 7; 8; 9; 10; 11 constitute independent solutions proposed by the invention in their own right. The objectives and associated solutions proposed by the invention may be found in the detailed descriptions of these drawings.

LIST OF REFERENCE NUMBERS

1 Gliding device
2 Ski
3 Binding mechanism
4 Top belt
4*a* Top belt strand
4*b* Top belt strand
5 Bottom belt
5*a* Bottom belt strand
5*b* Bottom belt strand
6 Core
7 Top face
8 Top layer
9 Bottom face
10 Running surface facing
11 Control edge
12 Control edge
13 Width
14 Slot
15 Depth direction
16 Gliding board slat
17 Gliding board slat
18 Width
19 Geometry-influencing means
20 Prising means
21 Prising angle
22 Bridging element
23 Plastic Later
24 Expansion fold
25 Stretching portion
26 Deflection
27 Apex line
28 Recess
29 Thickness

30 Thickness
31 Boundary edge
32 Boundary edge
33 Peripheral portion
34 Peripheral portion
35 Side edge
36 Side edge
37 Width
38 Clearance width
39 Overlap zone
40 Overlap zone
41 Distance
42 Support or guide surface
43 Support or guide surface
44 Force-transmitting element
45 Elongate hole
46 Elongate hole
47 Thrust surface
48 Thrust surface
49 Longitudinal side wall
50 Longitudinal side wall
51 Projection
52 Projection
53 Projection
54 Projection
55 Screw
56 Screw
57 Width
58 Binding mounting centre point
59 Screw means
60 Screw means
61 Bottom face
62 Coupling means
63 Coupling means
64 Projection
65 Projection
66 Recess
67 Recess
68 Tip portion
69 Profile height
70 Receiving depth
71 Composite body (multi-layered)
72 Bottom belt
73 Top belt
74 Core element
75 Top layer
76 Gliding layer
77 Binding anchoring layer
78 Sleeve
79 Thickness
80 Fixing point
81 Thickened region
82 Plate height
83 Screwing-in depth

What is claimed is:

1. A ski or snowboard comprising a gliding board body having a length extending in a longitudinal direction, a depth, a width, and a middle portion by reference to the width, said gliding board body being multi-layered and comprising:

at least one strength-imparting top belt;

at least one strength-imparting bottom belt;

at least one core disposed in between the at least one strength-imparting top belt and the at least one strength-imparting bottom belt;

at least one top layer forming a top face;

at least one running surface facing forming a bottom face;

at least one slot provided in the middle portion, said at least one slot having a depth extending from the top face of the gliding board body toward the at least one running surface facing so that the at least one slot divides at least (i) the at least one strength-imparting to belt, (ii) the at least one strength-imparting bottom belt and (iii) the at least one core into a first section defining a first gliding board slat positioned to the left of the at least one slot and a second section defining a second gliding board slat positioned to the right of the at least one slot, said at least one slot having a slot length extending essentially parallel to the longitudinal direction, said at least one slot causing a cross sectional weakening and reducing stiffness of the gliding board body transversely to the longitudinal direction; and at least one geometry-influencing mechanism comprising a plate-type force-transmitting element extending more than 50% of the length of the gliding board body and supported longitudinally in at least part portions on the top face of the gliding board body to transmit load, the plate-type force-transmitting element overlapping the at least one slot in the longitudinal direction and bridging the at least one slot transversely to the slot length, said at least one geometry-influencing mechanism producing a variable cross-sectional shape or contour of the gliding board body, the variable cross-sectional shape or contour being variable manually or as a function of load;

wherein the first gliding board slat lies essentially parallel to the longitudinal direction of the gliding board body; wherein the second gliding board slat lies essentially parallel to the longitudinal direction of the gliding board body; and wherein the plate-type force-transmitting element has a high torsional or twisting stiffness so that when one of the first gliding board slat and the second gliding board slat is affected by loads, a height offset in a direction perpendicular to the at least one running surface facing is inhibited or prevented within a portion of said one of the first gliding board slat and the second gliding board slat lying parallel to a portion of the at least one slot overlapping with the plate-type force-transmitting element.

2. The ski or snowboard as claimed in claim 1, wherein the gliding board body further comprises:

a binding mounting center point;

a rear end; and a front end;

wherein the plate-type force-transmitting element extends from the binding mounting center point across more than 50% of a first distance from the binding mounting center point to the rear end of the gliding board body, and across more than 50% of a second distance from the binding mounting center point to the front end of the gliding board body.

3. The ski or snowboard as claimed in claim 1, wherein the plate-type force-transmitting element extends across 51% to 96% of the length extending in the longitudinal direction of the gliding board body.

4. The ski or snowboard as claimed in claim 1, wherein the plate-type force-transmitting element functions as a load-transmitting support for a binding mechanism with respect to the gliding board body.

5. The ski or snowboard as claimed in claim 1, wherein at least one positively acting coupler is provided between a bottom face of the plate-type force-transmitting element and the top face of the gliding board body.

6. The ski or snowboard as claimed in claim 1, wherein at least one projection is provided on a bottom face of the plate-type force-transmitting element, the at least one projection accommodating a tip portion of a screw mechanism for a binding mechanism.

7. The ski or snowboard as claimed in claim 1, wherein the at least one slot has a slot width; and wherein the at least one geometry-influencing mechanism has at least one prying device for individually and adjustably varying the slot width of the at least one slot.

8. The ski or snowboard as claimed in claim 1, wherein the plate-type force-transmitting element is formed by a multi-layered composite body comprising a plurality of layers adhesively joined to one another.

9. The ski or snowboard as claimed in claim 1, wherein the slot length is between 20 cm and 100 cm; and wherein the at least one slot has a slot width in the middle portion of the gliding board body between 10 mm and 20 mm.

10. The ski or snowboard as claimed in claim 1, wherein the gliding board body further comprises:

a binding mounting zone;

a rear end; and a front end;

wherein the at least one slot is a first slot extending from a front end portion of the binding mounting zone in a direction towards the front end of the gliding board body and is a second slot extending from a rear end portion of the binding mounting zone in a direction towards the rear end of the gliding board body.

11. The ski or snowboard as claimed in claim 5, wherein the at least one positively acting coupler extends substantially within a mounting zone for a binding mechanism.

12. The ski or snowboard as claimed in claim 5, wherein the at least one positively acting coupler permits relative movements between the plate-type force-transmitting element and the gliding board body in the longitudinal direction of the gliding board body due to flexing of the gliding board body and prevents relative movements between the plate-type force-transmitting element and the gliding board body in a direction extending transversely to the longitudinal direction of the gliding board body and essentially parallel with the at least one running surface facing of the gliding board body.

13. The ski or snowboard as claimed in claim 6, wherein a profile height of the at least one projection and a plate height of the plate-type force-transmitting element are at least the same as or bigger than a screwing-in depth of the screw mechanism for securing the binding mechanism.

14. The ski or snowboard as claimed in claim 6, wherein the at least one projection is located in at least one complementary recess in the top face of the gliding board body.

15. The ski or snowboard as claimed in claim 7, wherein the gliding board body further comprises:

a longitudinal axis; and thrust surfaces on the top face of the gliding board body; and wherein by reference to a plane extending essentially parallel with the at least one running surface facing, the at least one prying device has at least two support or guide surfaces extending at an angle with respect to the longitudinal axis of the gliding board body, the at least two support or guide surfaces co-operating with the thrust surfaces on the top face of the gliding board body or with longitudinal side walls of the at least one slot.

16. The ski or snowboard as claimed in claim 8, wherein the plate-type force-transmitting element comprises at least one strength-imparting bottom belt element, at least one strength-imparting top belt element, at least one core element disposed in between the at least one strength-imparting bottom belt element and the at least one strength-imparting top belt element, and at least one top decorative layer.

17. The ski or snowboard as claimed in claim 8, wherein the multi-layered composite body of the force-transmitting element is formed using a hot press in at least one hot pressing operation for individual layers of the multi-layered composite body.

18. The ski or snowboard as claimed in claim 8, wherein a bottom face of the plate-type force-transmitting element is formed by a gliding layer made from plastic, the gliding layer being more abrasion-resistant than the top face of the gliding board body and having a low friction resistance.

19. The ski or snowboard as claimed in claim 14, wherein the gliding board body further comprises:

a binding mounting center point;

a rear end; and a front end; and wherein a profile height of the at least one projection and a receiving depth of the at least one complementary recess become smaller from the binding mounting center point in a direction towards the rear and front end of the gliding board body, continuously or in steps.

20. The ski or snowboard as claimed in claim 15, wherein the thrust surfaces are disposed on projections fixedly connected to the gliding board body.

21. The ski or snowboard as claimed in claim 15, wherein the at least two support or guide surfaces comprises at least one respective pair of support or guide surfaces extending at an angle with respect to the longitudinal axis in end portions of the plate-type force-transmitting element.

* * * * *